US006249996B1

(12) United States Patent
Dorber et al.

(10) Patent No.: US 6,249,996 B1
(45) Date of Patent: Jun. 26, 2001

(54) FLUID SUPPLY DEVICE FOR AN IRON

(75) Inventors: Ralf Dorber, Oberursel (DE); Antonio Rebordosa, Barcelona (ES); Josep Recasens, Barcelona (ES); Antonio Condes, Barcelona (ES); Miguel-Angel Colas Jimenez, Molins de Rei (ES); Desideri Sastre Falco, Barcelona (ES)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/486,496

(22) PCT Filed: Jul. 5, 1999

(86) PCT No.: PCT/EP99/04661

§ 371 Date: May 30, 2000

§ 102(e) Date: May 30, 2000

(87) PCT Pub. No.: WO00/01873

PCT Pub. Date: Jan. 13, 2000

(30) Foreign Application Priority Data

Jul. 3, 1998 (DE) ..... 198 29 675

(51) Int. Cl.[7] ..... D06F 75/22
(52) U.S. Cl. ..... 38/77.5
(58) Field of Search ..... 38/74, 75, 77.1, 38/77.5, 77.8

(56) References Cited

U.S. PATENT DOCUMENTS

| | | | | |
|---|---|---|---|---|
| 2,483,579 | | 10/1949 | Green . | |
| 2,700,236 | | 1/1955 | Marvin et al. . | |
| 3,811,208 | * | 5/1974 | Vieceli et al. | 38/77.8 |
| 3,829,993 | | 8/1974 | Gowdy et al. . | |
| 5,209,407 | * | 5/1993 | Farrington | 38/77.5 X |
| 5,526,594 | | 6/1996 | Fourny et al. . | |

FOREIGN PATENT DOCUMENTS

| | | |
|---|---|---|
| 1 177 199 | 3/1977 | (DE) . |
| 29 01 276 | 7/1980 | (DE) . |
| 2026861 | 9/1970 | (FR) . |
| 616571 | 1/1949 | (GB) . |
| 63-203196 | 8/1988 | (JP) . |

* cited by examiner

*Primary Examiner*—Ismael Izaguirre
(74) *Attorney, Agent, or Firm*—Fish & Richardson P.C.

(57) ABSTRACT

The invention is directed to a fluid transfer device for a pressing iron, with a housing accommodating therein a pump chamber, with a pump element for varying the pump chamber volume, and with an actuating member for actuating the pump element. According to the present invention, the fluid transfer device is characterized in that the actuating member is constructed as a deformable membrane.

25 Claims, 18 Drawing Sheets

Fig. 10
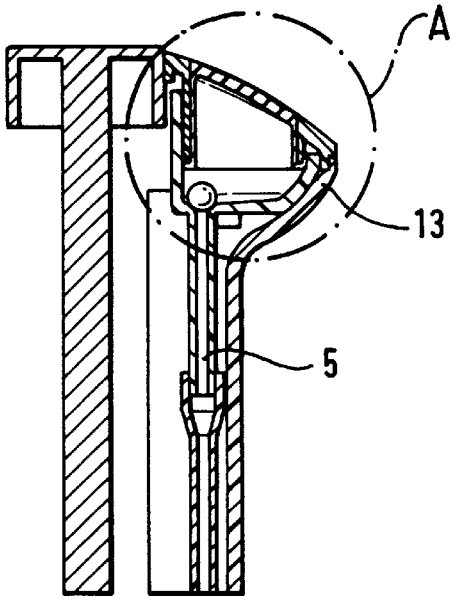
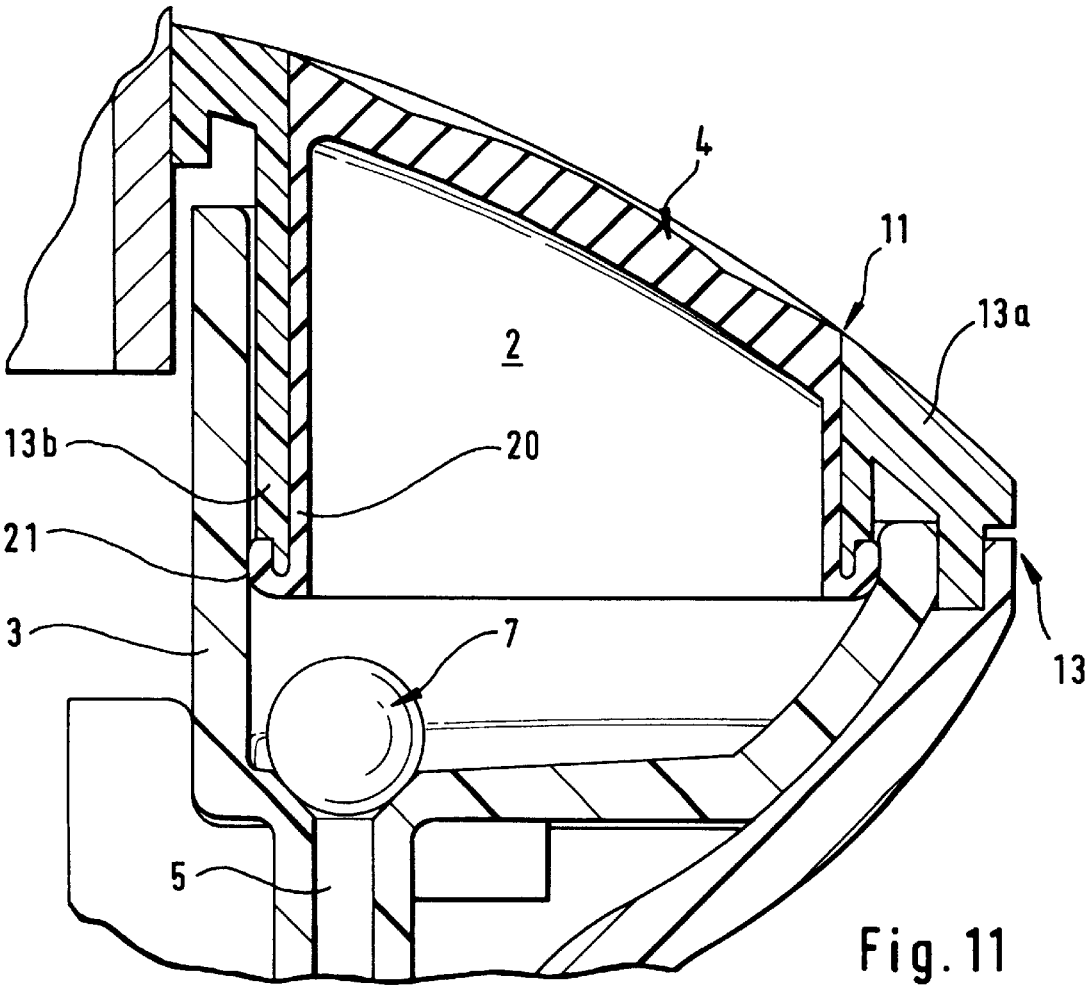
Fig. 11

Fig. 18
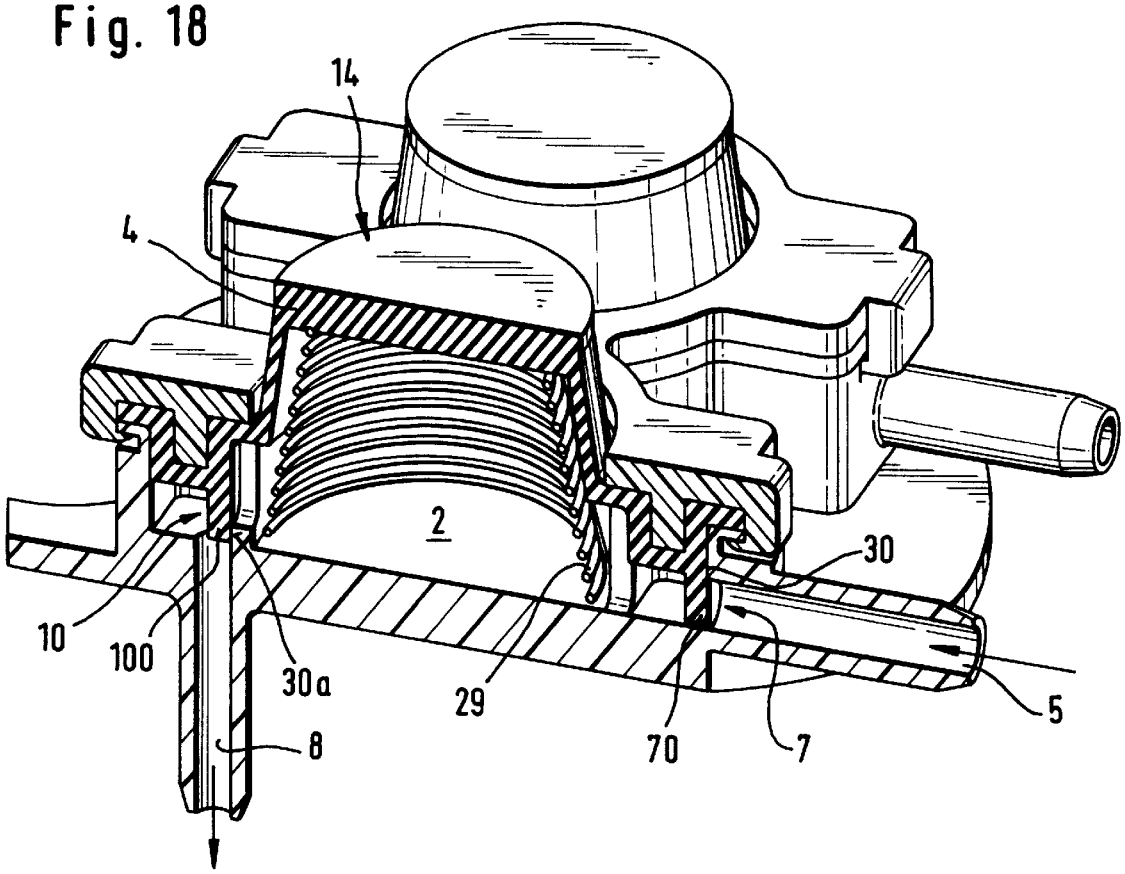
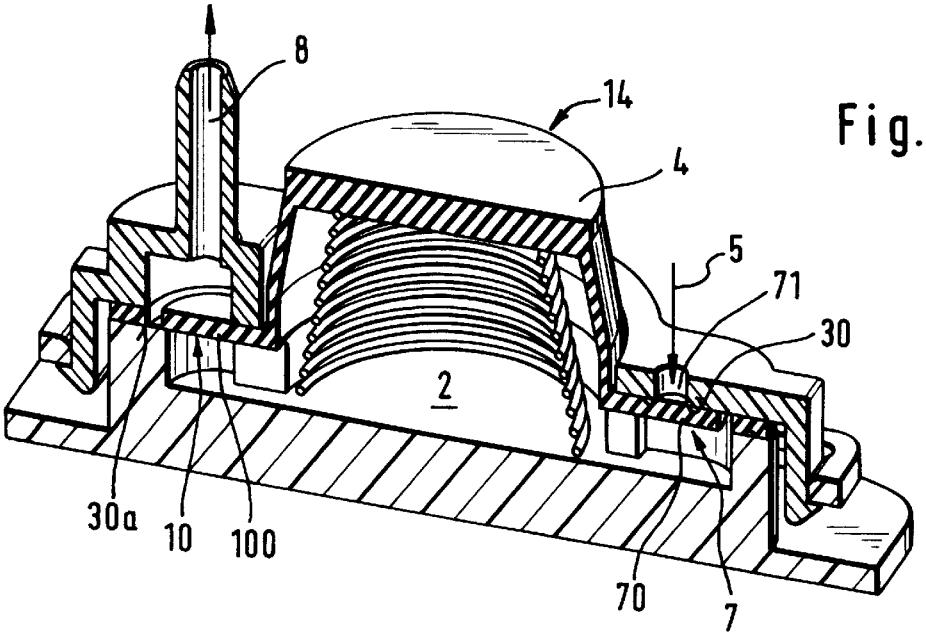
Fig. 19

FLUID SUPPLY DEVICE FOR AN IRON

BACKGROUND OF THE INVENTION

This invention relates to a fluid transfer device for a pressing iron.

Fluid transfer devices are used in pressing irons to spray water from a water reservoir in the interior of the iron through a nozzle ahead of the iron and onto the fabric to be ironed, or to direct the water to an evaporator so that a burst of steam is discharged, for example, from the underside of the iron. Fluid transfer devices of this type are customarily actuated by an essentially cylindrical control button which protrudes from the iron's housing and can be pressed down applying thumb pressure. From GB-A-2103663 a pressing iron is known whose fluid transfer device includes a compressible rubber bellows as pump chamber which can be compressed using a cup-shaped actuating button. Such fluid transfer devices are, however, relatively bulky and have disadvantages with regard to assembly and convenience of operation.

SUMMARY OF THE INVENTION

It is therefore an object of the present invention to provide an improved fluid transfer device for pressing irons which avoids the disadvantages of known fluid transfer devices. In particular it is desirable to provide a compact and easy-to-operate fluid transfer device of straightforward construction.

According to the present invention this object is accomplished in a fluid transfer device with the following features. The fluid transfer device essentially includes one lower module part and one upper module part between which a planar membrane foil is clamped in sandwich fashion, in which foil there are integrally formed both elastically movable valves and an elastically deformable membrane acting as pump element. This results in a very straightforward construction involving only three parts (excluding optional return springs for returning the pump element). Considering that in pressing irons it is conventional practice to use two pumps, one for example, for the spray function and one for the steam burst functions, this basic construction enables a fluid transfer device to be provided with two parallel integrated pumps involving likewise essentially three parts only. To accomplish this, in all housing module parts and the membrane corresponding multiple, parallel provision is made for pump elements, valves, channels, supply and discharge conduits. In all cases, a single membrane preferably performs both the valve and the pump functions.

In an advantageous further feature the sandwich construction operates to clamp the elastic membrane between hard plastic parts such as to cause the elastic membrane to deform and hence to seal the housing of the fluid transfer device against the outside. In addition, the membrane's elastic connecting sections between the pump element and the valves prevent leakage flow from occurring within the fluid transfer device. The housing and the pump element are constructed as two separate parts having a rigid connection between them. In particular the pump element can be clamped in place between two parts of the housing. The two housing parts can be joined together by a snap-on connection. Such a connection allows a particularly simple geometry of the pump element. The edge of the pump element can be clamped circumferentially in sandwich fashion. According to another embodiment of the present invention, the pump element can be connected with the housing in an elastic positive-engagement relationship. To this end the membrane has one, preferably several fastening sections which cooperate with complementary fastening sections of the housing. Advantageously, through this connection with or in the housing, the elastic membrane acts in peripheral areas at the same time as a seal, thereby obviating the added provision of a sealingly clamped O-ring. It is thus not necessary to make provision for further sealing means for the fluid transfer device.

A compact construction is also accomplished in that all liquid channels are already formed in the housing parts.

The membrane is advantageously a three-dimensional foil affording ease of manufacture using injection molding techniques.

For control of the fluid flow generated in the pump chamber, provision is preferably made for a respective valve, in particular a check valve, in a supply conduit and a discharge conduit of the pump chamber. An advantageous embodiment of the invention resides in that the valve is formed by the elastic membrane itself. In this embodiment the membrane of the pump element or actuating member has corresponding valve sections that are conformed to a corresponding valve passage so as to close the valve passage. When the pump element is actuated and fluid is transferred at a corresponding fluid pressure, the fluid pressure operates to move one of the valve sections away from its position closing the valve passage, causing the valve passage to be opened while the other valve section maintains its sealed condition. Forming the valves integrally by the elastic membrane itself reduces the number of components of the fluid transfer device, which results in a reduction of cost. The valves are made of an elastically sealing material (where applicable, integral with the membrane) in the form of planar movable sections which cooperate with rigid sections and are moved towards or away from these depending on whether a pressure below or above atmospheric prevails in the pump chamber.

Advantageously, at one valve section the valve foil is of a particularly thin-walled construction for the outlet of fluid and is provided with an opening with a diameter smaller than that of a pin of the lower module part, which pin projects through the opening. Experience has shown that this valve effects a particularly tight seal. Other valve sections are formed as elastic flaps moved by the fluid pressure during aspiration or discharge, releasing or closing an opening in one of the module parts.

The valve which is intended to prevent a return flow of the displaced fluid (or/and also the other valve) may also be constructed as a ball valve acted upon by a spring, where applicable. This allows a simple membrane geometry and greater freedom of valve arrangement. The aforedescribed integral formation of the valve by the membrane allows however a more compact construction of the fluid transfer device.

The aspiration of fluid into the pump chamber is generally effected by an elastic recovery of the membrane in its initial position upon an actuation, whereby the volume of the pump chamber is increased. Recovery of the membrane preferably takes place by its own accord as a result of the membrane's elasticity. To support the recovery or shorten the recovery period, in a further aspect of the invention or as an alternative a spring device may be provided as the sole restoring device for biasing the pump element into the position in which the pump chamber volume is at a maximum level. As spring device it is generally possible to use a separate spring element as, for example, a cylinder spring or a leaf spring. To reduce the number of components and thereby simplify the assembly, it is possible according to an advantageous embodiment of the present invention to form the spring element as one piece integral with a portion of the housing. In this way the housing possesses a spring portion acting upon the membrane in the direction of its position of rest as it is deformed from this position. The spring characteristic of the corresponding housing portion is accomplishable in particular by appropriately shaping this particular portion.

In a further aspect of the present invention, the membrane itself may include a spring portion which supports the self-supporting section of the membrane needing to be deformed and which is deformed on an actuation of the membrane. Hence the spring element may be formed in one integral piece with the membrane.

For a precise actuation of the fluid transfer device, the membrane is preferably configured such that a deformation resistance of the membrane in a position of rest of the membrane has an initially high value, dropping to lower values after an initial deformation is exceeded, said values being lower than the initially high value. As it is pressed in, the membrane thus possesses an initially high resistance which, with the pressing action continuing and after the initially high resistance is overcome, then drops to a lower value. The elevated defined pressure point of the membrane, in combination with the deformation resistance dropping non-linearly, particularly abruptly after the pressure point is overcome, effects a precise actuation, conveying the operator the feeling of a controlled and yet effortless actuation. This comfortable motion characteristic stands in clear contradiction to the characteristic of known bellows. Preferably the membrane may be of a convex configuration on its side facing away from the pump chamber. The dome-shaped form of the membrane causes the membrane to buckle in the peripheral area, whereby an initially high deformation resistance diminishes significantly.

To obtain an increased and stable pressure area, a central area of the membrane may be provided with greater thickness than in peripheral areas. The membrane possesses greater stiffness in the central area and an increased displacement area when the membrane is pushed towards the interior of the pump chamber.

To enable the operator to push the membrane with his finger with greater ease, the membrane may have a pressure area which is raised relative to a peripheral area, said pressure area being preferably about the size of an operator's finger tip.

In one variant, an actuating member for actuating the pump element is constructed as a deformable membrane. Hence, for actuation, an elastic membrane is provided which is deformable by applying finger-tip pressure. It is possible for the actuating device to be free from bulky push-buttons protruding from the iron's housing. This has the advantage of enabling the iron's housing to be constructed with greater design freedom and to be conformed to the user's hand in an ergonomically more favorable way. Constructing the actuating member as an elastic membrane has the effect of making operation of the fluid transfer device comfortably gentle and soft.

Advantageously, actuation is effected by deformation of the actuating member itself. The actuating member is preferably fixedly mounted relative to the housing, having in particular its circumferential edge connected with the housing. In consequence, there is no linear displacement of the entire actuating member. Advantageously, there is no space between the housing and the actuating member in which dirt could drop, which affords advantages with regard to maintaining the fluid transfer device and the iron in clean condition. The actuating member is operable multidirectionally, being not restricted to a predetermined direction of movement. Any jamming of the actuating member is precluded. Frictional resistances as they occur between a linearly displaceable control button and the housing when the button is pushed are avoided.

The actuating member may form part of the housing, that means, part of the housing is constructed as a deformable membrane. By contrast, the remaining part of the housing may be of rigid construction.

According to a preferred embodiment of the present invention the actuating member is directly constructed as pump element. The elastic membrane forms the pump element and bounds the pump chamber, enabling the pump chamber volume to be varied by deformation of the membrane and pumping of the liquid to be effected. The application of an operator's finger tip pressure is directly translated into a pump movement. By comparison with conventional fluid transfer devices, the number of components is reduced, which results in cost advantages particularly with regard to the assembly of the fluid transfer device. In addition, the dual function of the elastic membrane results in a highly compact arrangement of the fluid transfer device which is thereby reduced in size.

According to a further preferred embodiment of the present invention the pump element is spaced from the actuating member, said pump element being preferably constructed as an elastic membrane. Hence provision is made for two elastic membranes arranged in a spaced relationship to each other, with the possibility for the membrane provided as pump element to be generally constructed in conformity with the membrane provided as actuating member. The two membranes may be fabricated from different materials adapted for their respective functions. Thus, for example, the pump element membrane may be made of a silicone material while for the actuating member a soft polyethylene material as, for example, TPE may find utility which produces an esthetically pleasing outer surface. It is possible for the two membranes to be spaced from each other such a small distance that a deformation of the actuating member is transmitted directly to the pump element, meaning that the membrane of the actuating member is deformable in such manner that it touches the pump element directly or indirectly (see next paragraph), deforming it likewise.

Preferably, between the actuating member and the pump element provision can be made for a transmitting device, in particular a mechanically rigid transmitting element which transmits a movement of the actuating member to the pump element. This enables the pump element to be arranged in the interior of the iron independently of the position of the actuating member, making it in particular possible for the pump element to be arranged directly on or in the fluid reservoir in the interior of the iron. This shortens the path from the fluid reservoir to the pump element and the pump chamber. The fluid transfer device is in a position to respond directly. In cases where the module lower part is sealed tight with the upper side of the fluid reservoir bottom (for example, by plastic welding together of the two parts), it is not only possible to form fluid channels by the cooperation of the fluid reservoir bottom with the lower module part, but also to make provision for short discharge conduits to the injection location of the underlying steam conduit in the steam generating chamber for the steam burst and to the water spray.

In a still further aspect of the present invention, the pump element and the housing are integrally formed as a two-component injection molding. Accordingly, the membrane and the housing are coupled by mating materials. Forming the membrane integrally with the housing effects a particularly simple construction involving few components.

With regard to the outer appearance of the iron's housing, the construction of the actuating member as elastic membrane affords particular advantages.

In a particular embodiment the membrane of the actuating member is arranged so as to be essentially flush with the outer surface of the iron's housing, being essentially a continuation of the outer surface of the iron's housing. The iron's housing is also flat in the area of the actuating member, being free from projections, for example, and it possesses a smoothly extending surface. The iron's housing may also be constructed as a grip part in the area of the actuating member. Alternatively, ergonomically shaped projections may be formed as controls. The membrane of the actuating member may be part of the iron's housing, in particular the membrane may be formed integrally with the iron's housing as a two-component injection molding.

In another aspect of the present invention, the housing of the fluid transfer device may be fixedly connected with the iron's housing, in particular with a handle section of the iron's housing. The connection can be accomplished preferably by two-component injection molding, plastic welding or adhesive bonding. According to another embodiment provision is made for a snap-on or press-fit connection using, where applicable, a seal. Where appropriate, the housing of the fluid transfer device may be formed by a correspondingly shaped section of the iron's housing at least in part.

These and further features, application possibilities and advantages of the present invention will become apparent not only from the claims but also from the description and the drawing. It will be understood that any single feature and any combination of single features described or represented by illustration form the subject-matter of the present invention, irrespective of their summary in the patent claims or their back reference, as well as irrespective of their wording and representation in the description and the drawing, respectively. Embodiments of the present invention will be explained in more detail in the following with reference to the accompanying drawing.

BRIEF DESCRIPTION OF THE DRAWINGS

FIG. 10 is a sectional view of the pump chamber of a fluid transfer device arranged in the handle of the pressing iron according to a further embodiment of the present invention;

FIG. 11 is an enlarged view of the detail designated as A in FIG. 10 and showing the connection of the membrane with the pump chamber housing and its connection with the handle of the pressing iron;

FIG. 18 is a perspective sectional view of the pump chamber of an embodiment in which the membrane has integrally formed valve sections acting in the supply conduit and the discharge conduit as check valve each;

FIG. 19 is a perspective sectional view of a pump chamber similar to FIG. 18 in which the membrane has integrally formed valve sections, according to a further embodiment of the present invention;

DETAILED DESCRIPTION

Figure 1:
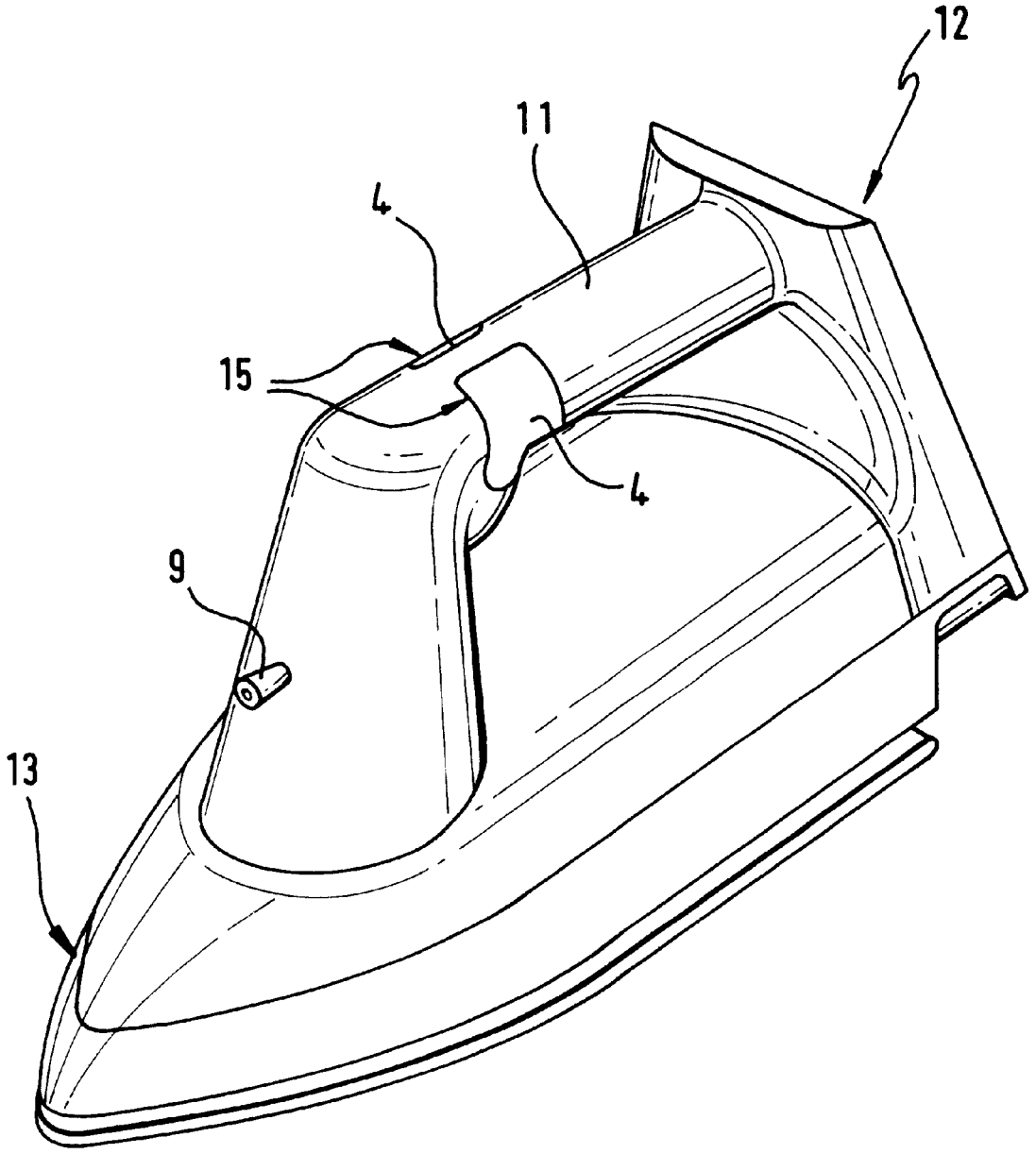
FIG. 1 is a perspective view of a pressing iron with two actuating members of a fluid transfer device which are arranged in a handle of the pressing iron, in accordance with one embodiment of the present invention.

The fluid transfer device possesses a housing 1 encompassing a pump chamber 2. In this arrangement, the pump chamber 2 is bounded by a rigid housing portion 3 an elastic membrane 4 connected therewith which combine to form the housing 1 (see FIG. 2). Hence the housing 1 includes a rigid portion and a deformable portion.

The elastic membrane 4 is provided as a pump element enabling the volume of the pump chamber 2 to be varied and a pumping effect to be thereby accomplished. The pump chamber 2 communicates through a supply conduit 5 with a fluid reservoir 6, so that fluid can be aspirated from the fluid reservoir 6 into the pump chamber 2. Inserted in the supply conduit 5 is a check valve 7 which permits a fluid flow from the fluid reservoir 6 to the pump chamber 2 while yet preventing a return flow in the opposite direction. On the downstream side the pump chamber 2 communicates through a discharge conduit 8 with a discharge nozzle 9 enabling the fluid to be delivered as a spray. The discharge conduit 8 could also be routed to an evaporating device in order to vaporize the fluid and cause it to be delivered as a burst of steam ahead of or underneath the pressing iron, for example.

Figure 2:
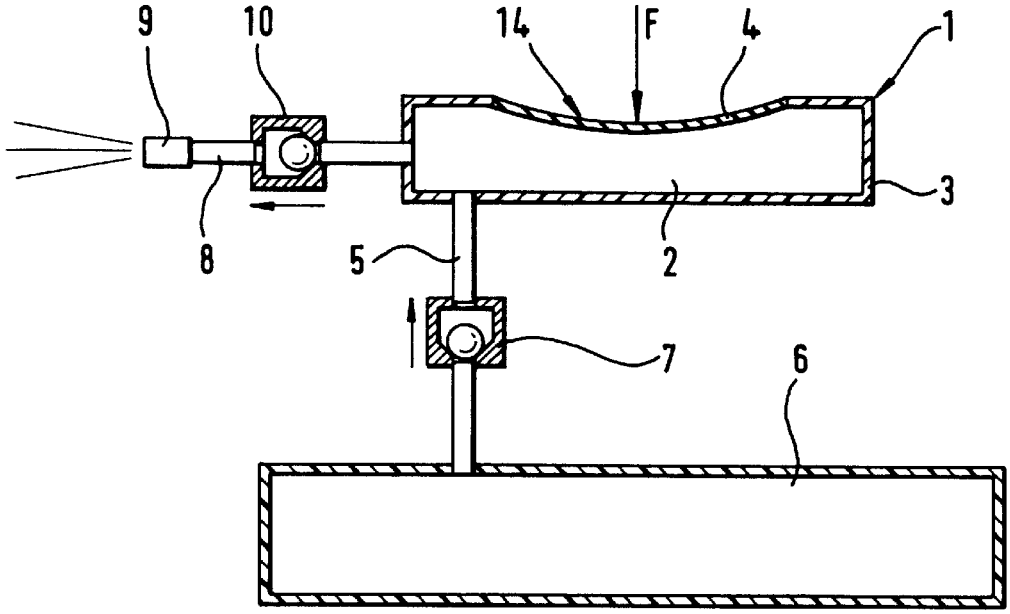
FIG. 2 is a schematic representation depicting the function of the fluid transfer device comprising a pump chamber connected through a supply conduit with a fluid reservoir and through a discharge conduit with a spray nozzle.

Provided in the discharge conduit 8 is a check valve 10 which permits fluid flow from the pump chamber 2 to the discharge device 9 while yet preventing a return flow to the pump chamber 2 (see FIG. 2).

To transfer fluid, pressure exerted on the elastic membrane 4 in the direction of arrow F of FIG. 2 urges the membrane into the interior of the pump chamber 2, causing the pump chamber volume to be diminished and, if applicable, to urge the fluid already contained therein through the discharge conduit 8 to the nozzle 9. Upon termination of pressure application F, the membrane 4 returns elastically to its initial position, causing the pump chamber volume to increase again. As a result, fluid is aspirated from the fluid reservoir 6 through the supply conduit 5 into the pump chamber 2. The check valve 7 is in its position opening the supply conduit 5, while the check valve 10 is pulled or urged into its position closing the discharge conduit 8. By pressing the elastic membrane 4 down again so that the volume of the pump chamber 2 diminishes again, the aspirated fluid in the pump chamber 2 is forced through the discharge conduit 8 and out of the nozzle 9. As a result of the increased fluid pressure in the pump chamber 2, the check valve 10 is pushed open, while the check valve 7 in the supply conduit 5 closes said conduit.

According to an embodiment of FIG. 1, the fluid transfer device shown in FIG. 2 is arranged in a product for personal use, in this case directly in the handle 11 of a pressing iron 12, with the fluid reservoir 6 being located in the lower, and the nozzle 9 in the forward, area of the iron's housing 13, in particular of the handle 11, in order to spray the fluid ahead of the iron onto the fabric needing to be ironed.

As FIG. 1 shows, the elastic membrane 4 is embedded in the iron's housing 13 so as to be flush with the outer surface thereof or is fused therewith, as will be explained later in more detail, forming essentially a continuation of the outer surface of the handle 11 and being part of the gripping area by which the pressing iron 12 can be gripped. In this arrangement the membrane 4 provided as pump element 14 forms at the same time directly the actuating member 15 suitable for the purpose of finger tip control, particularly thumb control by the hand gripping the pressing iron, in order to effect a fluid transfer. Designing the actuating member 15 directly as pump element reduces the number of components, thereby simplifying the structure and the assembly of the fluid transfer device. The design of the actuating member 15 as elastic membrane enables the membrane to be provided as part of the gripping area and the handle 11 to be free from projections such as push-buttons. In its most favorable position the actuating member 15 can be arranged in the direct vicinity of the fingers embracing the handle 11, enabling the handle 11 to be built in an ergonomically advantageous manner. This is also made possible because the membrane structure enables the fluid transfer device to be designed in a comparatively flat form hence requiring little depth towards the interior of the pressing iron while yet providing for an adequate volumetric delivery.

As FIG. 1 shows, provision is made in the handle 11 for two fluid transfer devices having their actuating members 15 arranged on the right and, respectively, left upper side of the handle 11. In this arrangement one fluid transfer device is associated with the spray nozzle 9, while the other fluid transfer device communicates with a steam generating chamber and steam burst discharge ports on the underside of the pressing iron 12.

Figure 3:
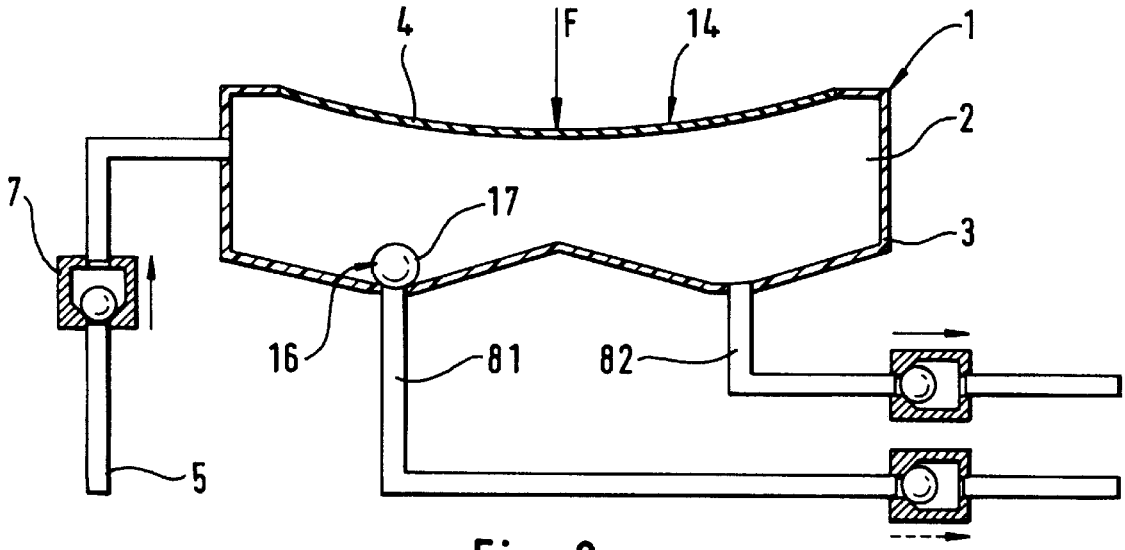
FIG. 3 is a schematic representation depicting the function of a fluid transfer device according to a further embodiment in which the pump chamber is selectively connectable with two different discharge conduits.

To obtain a still more compact structure, it is possible according to a further preferred embodiment (see FIG. 3) to provide the fluid transfer device with a dual function and to operate several fluid supply destinations from one fluid transfer device. For this purpose, the pump chamber 2 is in communication with several discharge conduits. Provision is made for a selector device 16 capable of selectively establishing fluid communication between a respective one of the discharge conduits and the pump chamber 2. Different designs of the selector device 16 are possible including, for example, a selector lever operable from outside. Preferably, however, the selector device 16 includes a ball 17 movably arranged in the interior of the pump chamber 2 and closing one of the two discharge conduits 81 and 82 in the corresponding position. In this arrangement means are provided which force the ball 17 either into the position closing the discharge conduit 81 or into the position closing the discharge conduit 82. Advantageously, as shown in FIG. 3, the bottom of the pump chamber 2 includes two troughs at the deepest point of which the ports of the discharge conduits 81 and 82 are arranged. The trough-shaped depressions formed in the bottom of the pump chamber 2 are separated from each other by a ridge. Gravity urges the ball 17 to the deepest point of a trough where the ball then closes the corresponding discharge conduit. To switch fluid communication from one of the discharge conduits to the other, it is only necessary for the pressing iron and hence the fluid transfer device to be tilted correspondingly, that is, out of its normal horizontal position so that the ball 17 rolls from the one trough-shaped depression into the other. This enables the pump chamber 2 to be selectively connected with the spray nozzle 9 or the steam burst device on the underside of the pressing iron 12.

Figure 4:
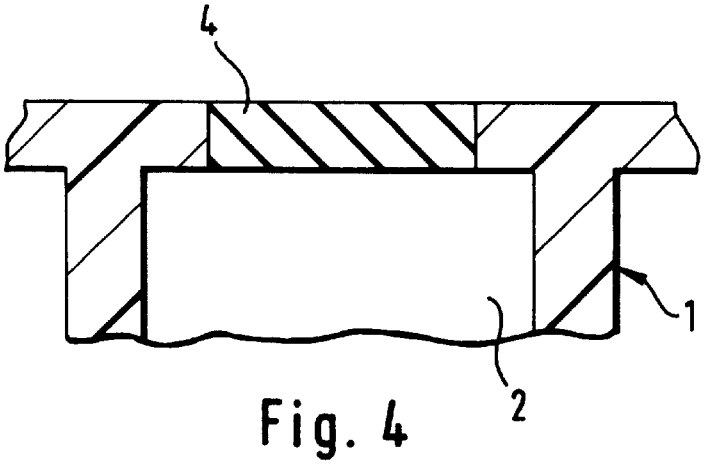
FIG. 4 is a detail representation showing the connection of the membrane with the housing according to one embodiment in which the housing and the membrane are fabricated as a two-component injection molding.

In particularly advantageous manner, the elastic membrane 4 is formed in one integral piece with the housing 1 (see FIG. 4). Hence a rigid housing portion 3 and the elastic membrane 4 combine to form a one-piece construction comprising a soft, deformable section and a rigid section. Preferably the elastic membrane 4 and the housing 1 are a two-component injection molding. For one purpose, the integral design of membrane and housing reduces the number of components. For another purpose, joints in which dirt could accumulate or projections and the like are avoided. In particular when the iron's housing 13 forms part of the pump housing 1, the elastic membrane 4 as actuating member 15 can be a flush continuation of the surface of the iron's housing 13 and form part of the gripping area of the handle 11. By virtue of the two-component injection molding structure, a circumferential and fluid-tight joint withstanding high loads is effected between the membrane 4 and the housing 1.

Figure 5:
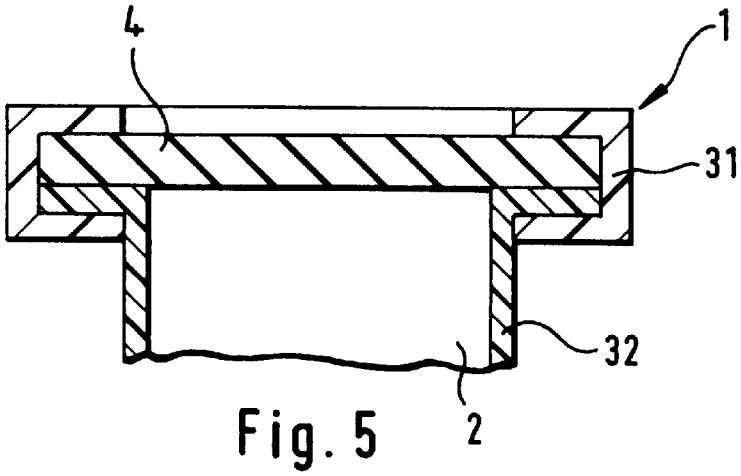
FIG. 5 is a representation showing the connection of the membrane with the housing according to a further embodiment involving a clamped joint.

According to a further advantageous embodiment of the resent invention (see FIG. 5), the housing 1 and the elastic membrane 4 form two separate parts. The elastic membrane 4 is in fluid-tight connection with the rigid housing portion 3 circumferentially along its edge. As FIG. 5 shows, the membrane 4 has its edge clamped in sandwich fashion between two housing portions 31 and 32. Where a two-part structure of membrane and housing is involved, a high degree of freedom exists in the combination of materials usable for the membrane and the housing.

Figure 6:
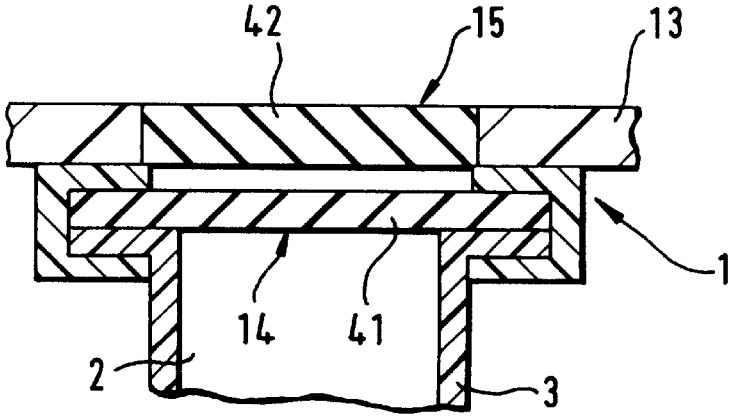
FIG. 6 is a representation, similar to FIGS. 4 and 5, of a further embodiment providing two relatively spaced membranes.
Figure 7:
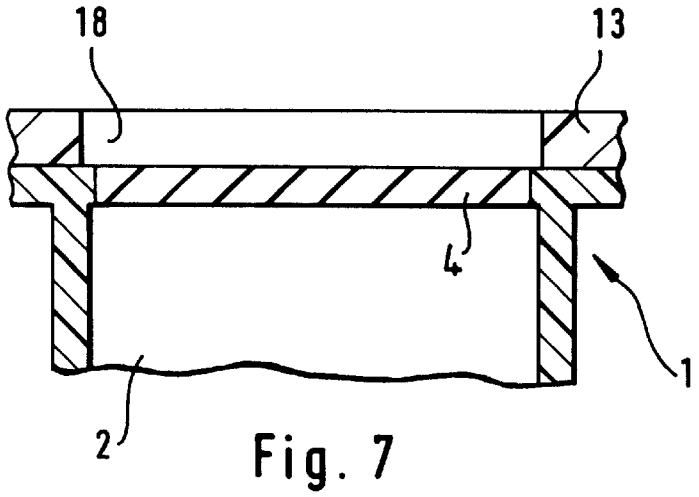
FIG. 7 is a representation, similar to FIGS. 4 to 6, of a still further embodiment in which the fluid transfer device forms an assembly separate from the iron's housing and the membrane of the fluid transfer device is actuatable through a cutout in the iron's housing.

To obtain a flawless outer surface on the one hand and a best possible configuration of the pump element 14 on the other hand, provision can be made for two membranes 41 and 42. One membrane 42 provided as actuating member 15 on the outside of the housing 1 is preferably formed in one integral piece with the housing 1 as a two-component injection molding fabricated in particular from TPE. The inner membrane 41 provided as pump element 14 can be fabricated from a material ideally suited for this function as, for example, silicone. As FIG. 6 shows, the transfer unit incorporating the pump chamber 2 and the pump element 14 is independent of the iron's housing 13 incorporating the actuating member 15.

For complete disengagement of the iron's housing 13 from the fluid transfer device it is possible for the fluid transfer device with its housing 1 and the elastic membrane 4 to be horizontally mounted underneath the iron's housing 13, a cutout 18 being then provided in the iron's housing 13 to allow access to the membrane 4 from outside. In this arrangement, the elastic membrane 4 forms both the pump element 14 and the actuating member 15.

Figure 8:
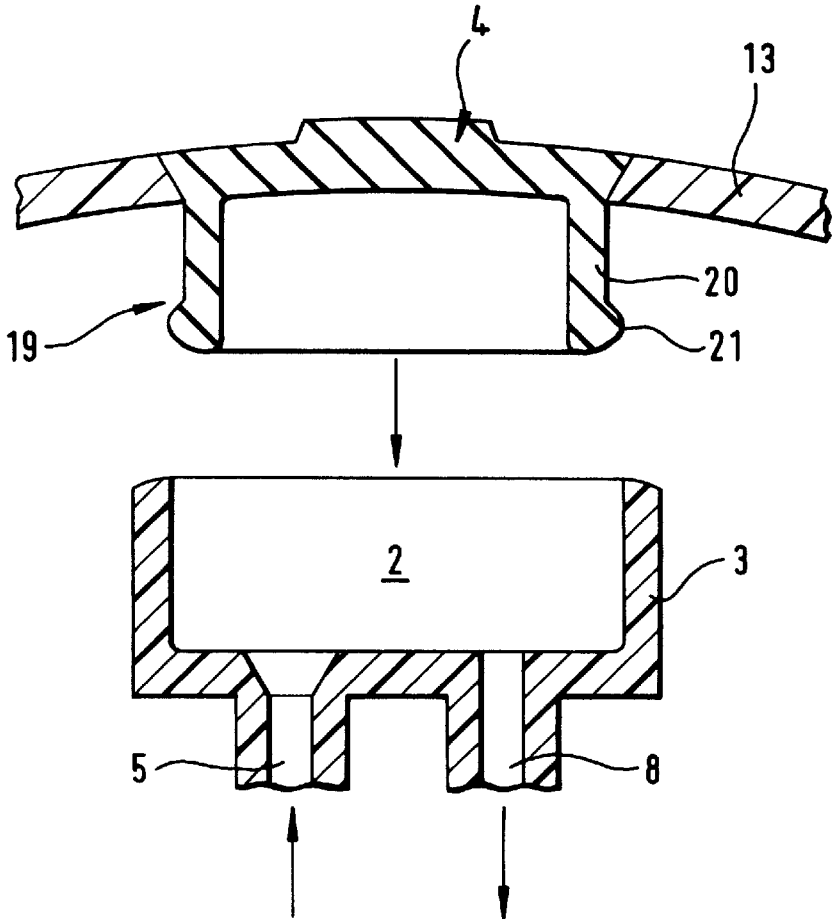
FIG. 8 is a schematic representation showing the connection of the housing parts bounding the pump chamber according to one embodiment of the present invention.

Conveniently, the housing 1 encompassing the pump chamber 2 is a two-part construction in which the two housing portions are joined together by means of a fluid-tight connection. Suitable joining methods include welding or adhesive bonding or, alternatively, are implemented by positive engagement using, for example, a snap-on connection, or by frictional engagement using a press-fit connection. Where applicable, a seal may be provided between the two housing portions. As FIG. 8 shows, an advantageous embodiment resides in that the elastic membrane 4 which forms both actuating member and pump element is embedded in the iron's housing 13 against which the rigid housing portion 3 of the pump chamber housing 1 is positioned from the inside. In this arrangement preferably the rigid housing portion 3 is joined to the inside of the iron's housing 13 in a firm and fluid-tight relationship around the membrane 4. Preferably the elastic membrane 4 as seal 19 has a circumferential annular seal section 20. As FIG. 8 shows, the seal section 20 forms an extension protruding into the pump chamber 2 in the manner of a collar having a circumferential sealing area 21 which cooperates with the inside of the rigid housing portion 3. In relation to the inner circumference of the pump chamber 2 the circumference of the seal section 20 is dimensioned so that the sealing area 21 is elastically biased into engagement with the inside of the rigid housing portion 3. The embodiment illustrated in FIG. 8 effects a particularly straightforward structural design of the pump arrangement.

Figure 9:
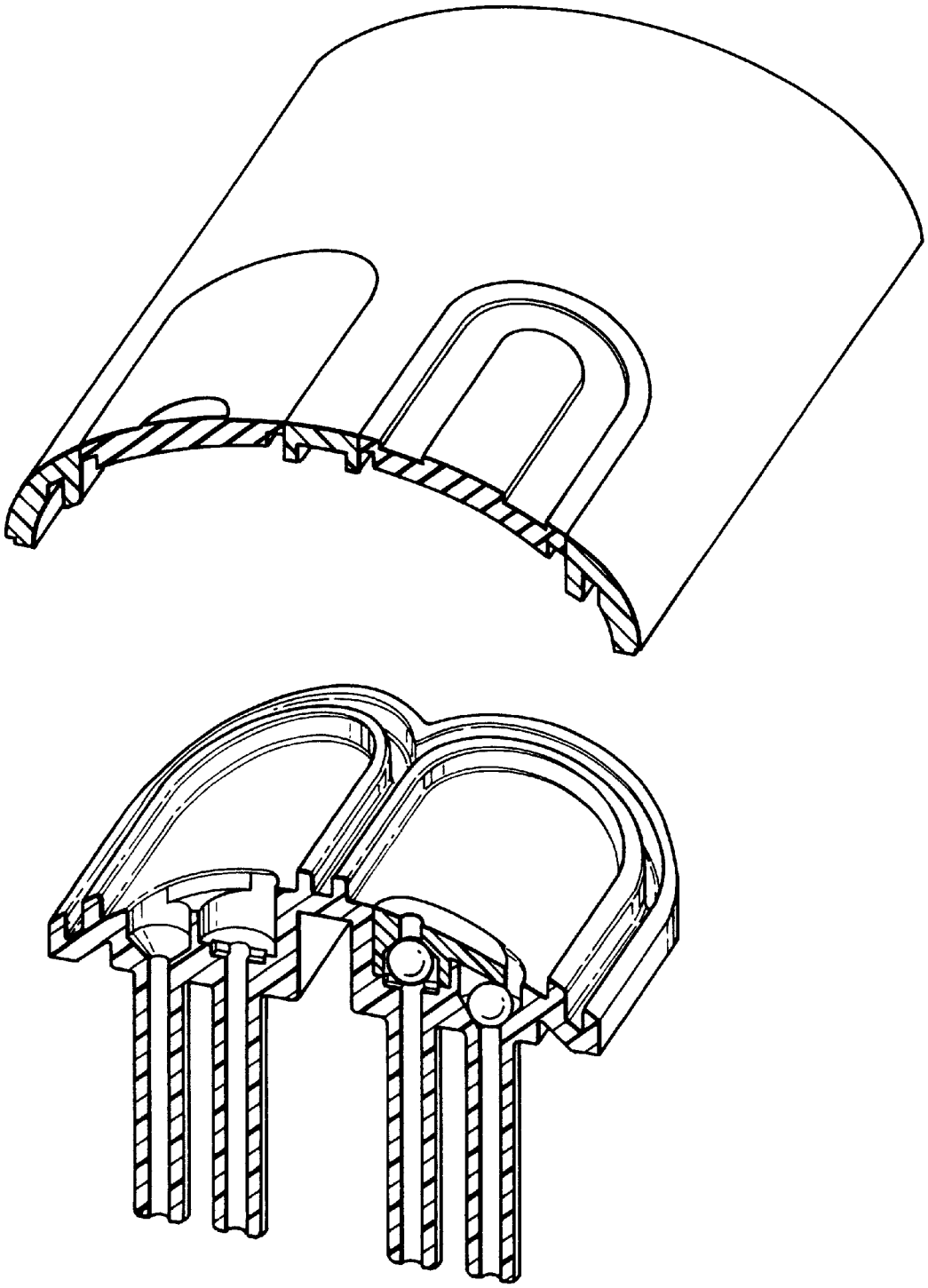
FIG. 9 is a perspective sectional view of the connection of the housing parts bounding the pump chamber according to another embodiment of the present invention.

To ensure a secure seating engagement of the two housing portions when one is placed on top of the other, these may have complementary projections and cutouts or recesses having inter-fitting engagement when assembled together (see FIG. 9).

A particularly advantageous embodiment of the present invention is shown in FIGS. 10 and 11, with FIG. 11 being an enlarged view of the detail designated as A in FIG. 10. The iron's housing 13 is a multi-piece construction, one housing part 13*a* having inserted therein the elastic membrane 4 of the fluid transfer device. The elastic membrane 4 has a circumferentially closed seal section 20 projecting into the pump chamber 2, bearing with its outside against a seal carrier 13*b* of the iron's housing part 13*a* which for conformity with the seal section 20 is formed as a circumferential ledge protruding towards the interior of the housing. In this embodiment the seal section 20 embraces one end of the seal carrier 13*b* elastically by positive engagement therewith. As FIG. 11 shows, the seal section 20 has one of its ends formed in the manner of a U-shaped bead between whose legs the end of the ledge-shaped seal carrier 13*b* is engaged. Provided on the outside of the end of the seal section 20 embracing the seal carrier 13*b* is the sealing area 21 which is in sealing engagement with the rigid housing portion 3 of the pump chamber 2 (see FIG. 11). By means of the seal carrier 13*b* it is possible to increase the elastic bias of the seal section 20 against the inside of the pump chamber housing 1 and to ensure a tight seal of pump chamber 2.

Figure 12:
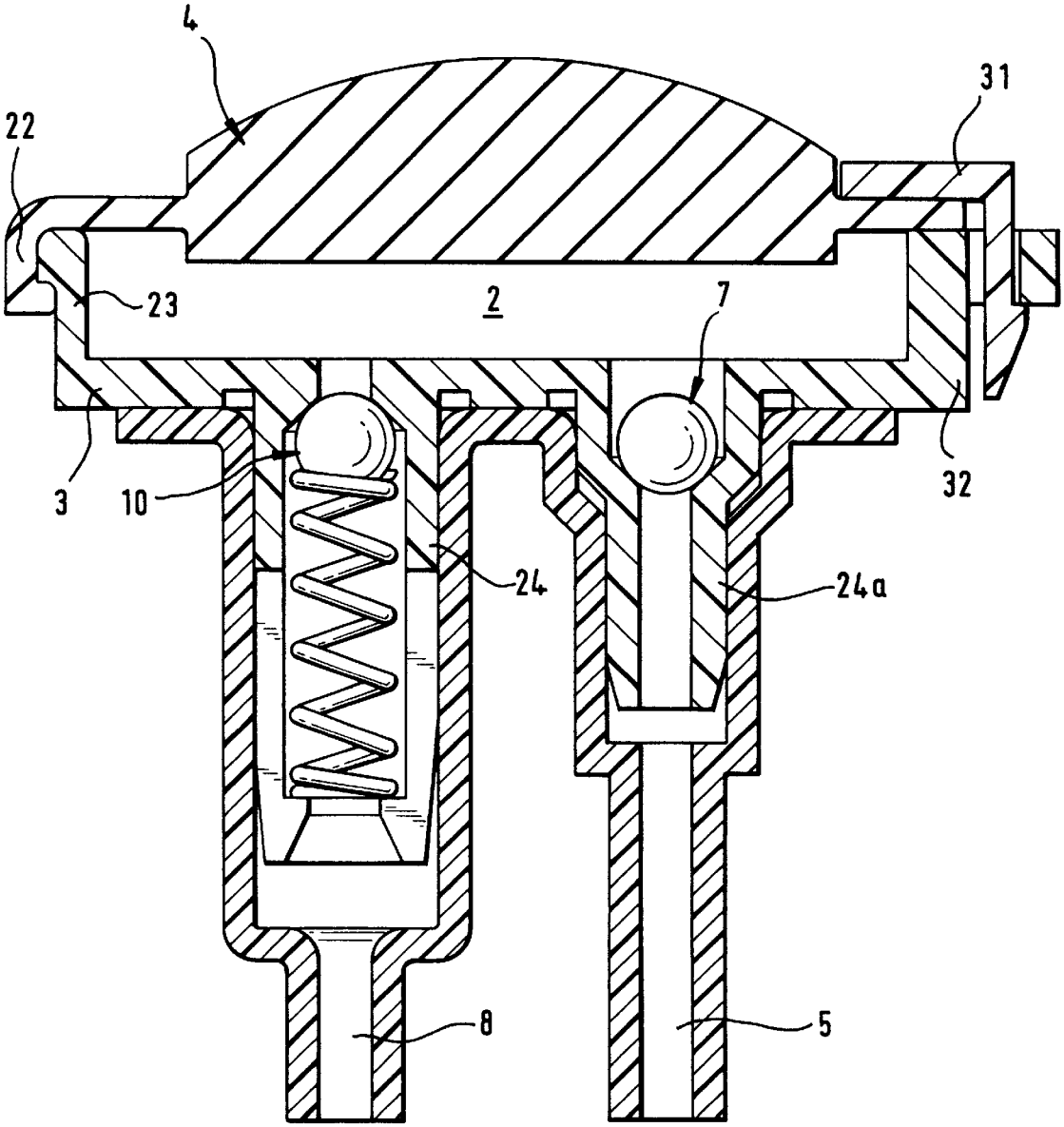
FIG. 12 is a cross-sectional view of the pump chamber of a fluid transfer device according to a further embodiment comprising check valves in the supply conduit and the discharge conduit, and a membrane having its central region thickened.

FIG. 12 shows a further embodiment of the present invention in which the membrane is designed as a part separate from the pump housing 1, there being illustrated two different possibilities of fastening the membrane. According to the left-hand side the membrane 4 has an annular fastening ledge 22 projecting vertically towards the central area of the membrane and having a notch on its inside. The rigid housing portion 3 of the pump housing 1 has a membrane holder 23 complementary with the fastening ledge 22 and likewise formed as a circumferential ledge protruding towards the membrane. The fastening ledge 22 of the membrane can be slid over the membrane holder 23 elastically, thereby effecting an elastically biased connection between the fastening ledge 22 and the membrane holder 23.

The right-hand half of FIG. 12 shows a further fastening possibility for the membrane 4. In this arrangement the disk-shaped edge of the membrane 4 is clamped in sandwich fashion between two housing portion 31 and 32 of the rigid housing portion 3, the two housing portions 31 and 32 being adapted to be latched in the manner of a snap-on connection (see FIG. 12).

In its central area the membrane 4 is of greater thickness than in its peripheral area, whereby a larger volume change of the pump chamber 2 and a correspondingly more effective pump action are accomplished. In the membrane's central area the outside of the membrane 4 is of a convex configuration, its arch pointing in the direction of an operator's finger. Such a pressure area which is raised relative to the periphery of the membrane 4 results in a comfortable and effortless actuation of the elastic membrane 4.

As shown in FIG. 12, a ball valve operating as check valve 7 and 10 is provided in the supply conduit 5 and the discharge conduit 8, respectively. In particular the check valve 10 in the discharge conduit 8 is spring-loaded and biased into its closed position to prevent the escape of fluid. For greater ease of assembly, the supply conduit 5 and the discharge conduit 8 are formed separately from the housing 1 of the pump chamber 2, the housing 1 having collars 24*a* and 24 to which the supply conduit 5 and the discharge conduit 8, respectively, are attachable. It will be understood, of course, that the housing 1 could also be provided with corresponding recesses into which the conduits 5 and 8 could be plugged. The collars 24*a* and 24 identified are however, of particular advantage with regard to a secure connection and make it possible for the check valves to be arranged in the pump chamber housing 1.

To permit the use of a check valve controlled by gravity and prevent a movement of the valve body away from its associated valve seat, provision may be made for a valve body stop. According to an advantageous embodiment of the present invention shown in FIG. 13, the membrane 4 includes as valve body stop 25 a projection extending in the direction of the valve body 26 and limiting the movement of the valve body 26 so as to prevent its movement away from its corresponding valve seat. Gravity urges the valve body 26 into engagement with its valve seat. When the elastic membrane 4 is pressed down, the increased fluid pressure in the pump chamber 2 and the elastic valve body stop 25 operate in addition to urge the valve body 26 of the check valve 7 associated with the supply conduit 5 into its position closing the supply conduit. As this occurs, the valve body stop 25 is deformed elastically.

Figure 13:
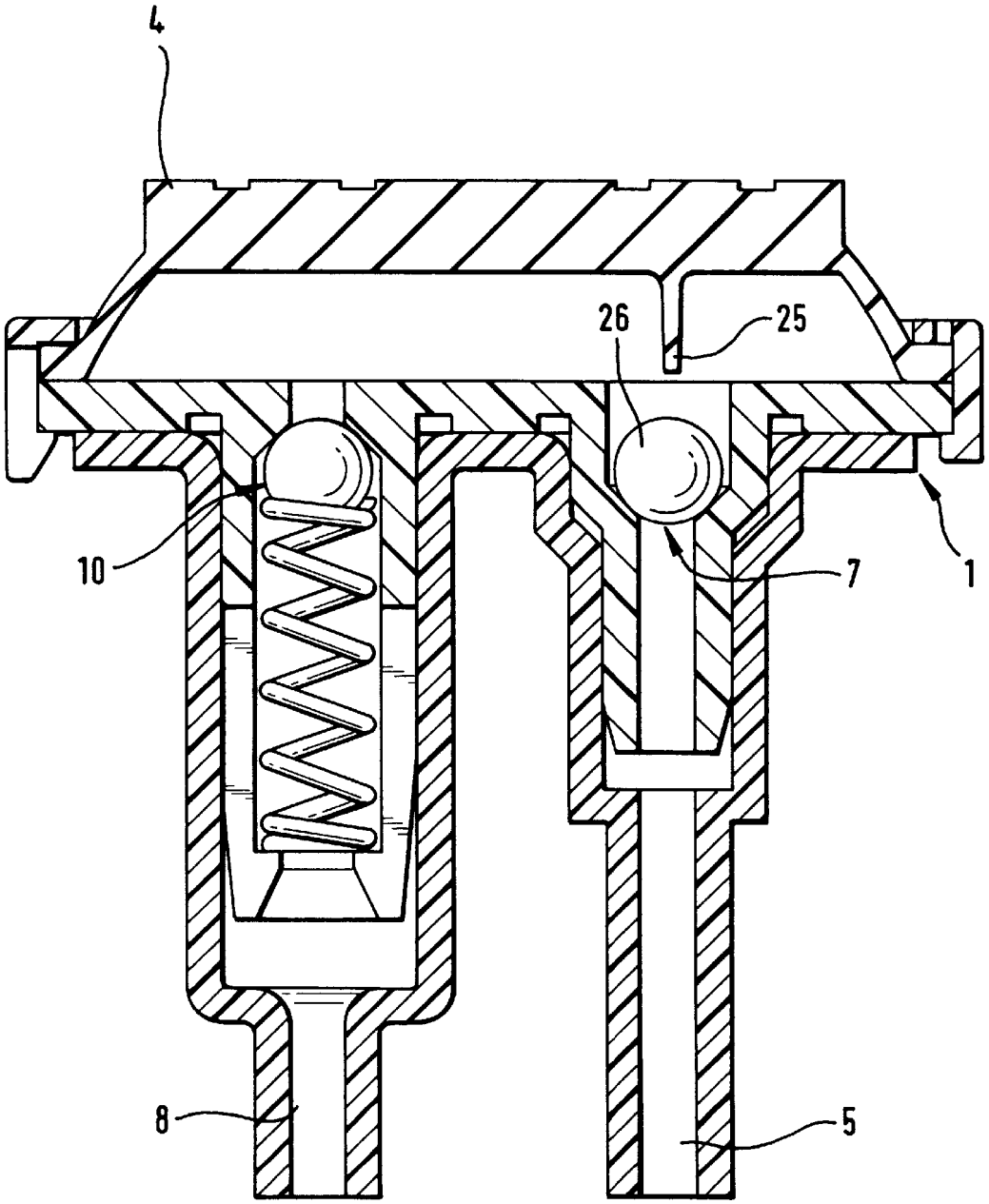
FIG. 13 is a cross-sectional view of the pump chamber similar to FIG. 12 according to a further embodiment of the present invention in which the membrane is of a dome-shaped configuration and has a hold-down device for the check valve disposed in the supply conduit.

As FIG. 13 shows, in its peripheral area the membrane is of a conical configuration and of reduced thickness by comparison with its central area, causing the peripheral area to buckle as the membrane 4 is depressed. This results in a defined pressure point. Initially, in its position of rest, the membrane 4 has a relatively high deformation resistance which drops to a lower level relatively rapidly after this increased initial resistance is overcome, that is, upon buckling of the peripheral area of the membrane 4. This effects a distinct and powerful actuation of the fluid transfer device.

Figure 14:
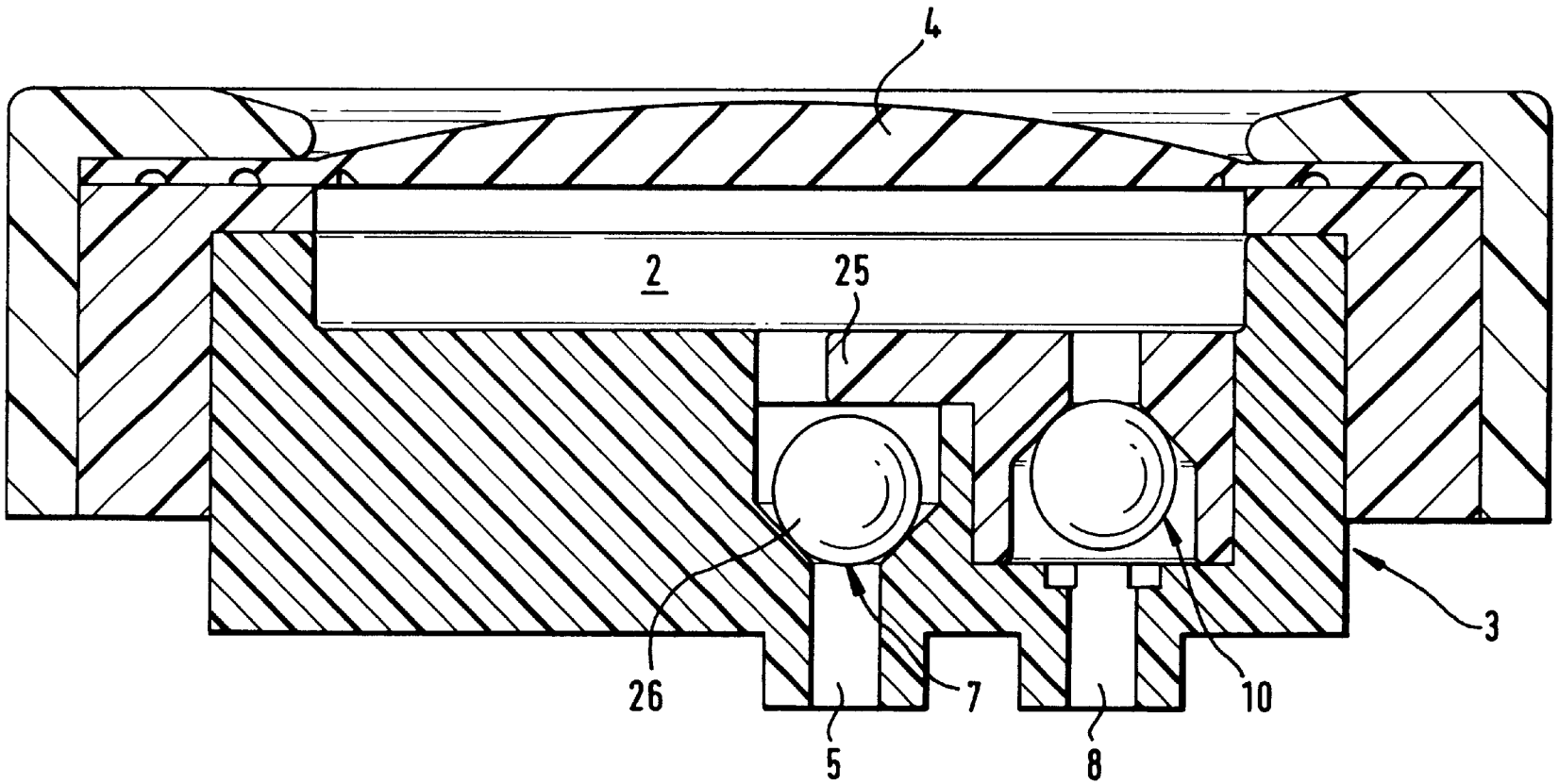
FIG. 14 is a cross-sectional view of a pump chamber similar to FIGS. 12 and 13, illustrating another embodiment.

Similarly, the embodiment of FIG. 14 has a check valve controlled only by gravity and the pressure variations in the pump chamber 2 and the corresponding fluid flow directions. The valve bodies of both check valves 7 and 10 have only a relatively short valve travel in which they can be moved. The valve body stop 25 for the valve body 26 of the check valve 7 is formed by a section of the rigid housing portion 3. As FIG. 14 shows, the valve seat for the check valve 10 in the discharge conduit 8 is configured as an insert suitable for insertion into a corresponding recess of the housing portion 3. The valve seat insert has at the same time a section acting as valve body stop 25 for the valve body 26 of the check valve 7 associated with the supply conduit 5.

The membrane 4 is of an essentially disk-shaped configuration, its thickness increasing continually from the periphery to the central area of the membrane 4. The outside of the membrane 4, that is, the side of the membrane 4 close to the finger of the user of the pressing iron, is arched in convex shape for convenience in handling the membrane. When the membrane is actuated, the essentially disk-shaped configuration causes the membrane to be subjected substantially to tension. As a result, uniform actuation of the membrane is ensured. Uniform subjection of the membrane to tension nearly exclusively results in a long service life.

Figure 15:
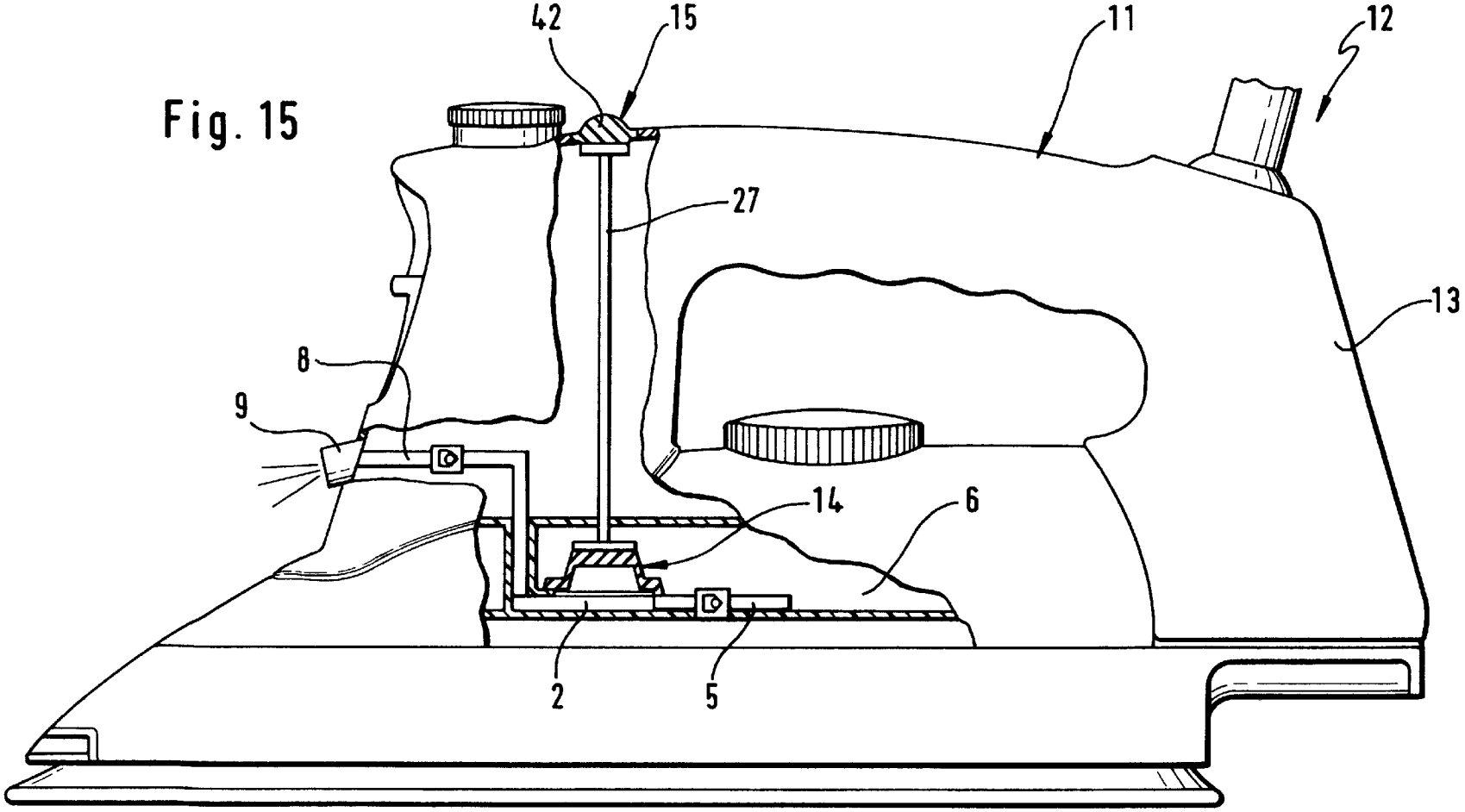
FIG. 15 is a schematic representation showing a pressing iron in part sectional view in which according to a further embodiment of the present invention the pump chamber of the fluid transfer device is not arranged in the handle of the iron, but rather, directly in the water reservoir of the iron.

A further embodiment of the present invention is illustrated in FIG. 15. The pump chamber 2 and the pump element 14 are arranged directly in the interior of the fluid reservoir 6. This enables the supply conduit 5 to be of very short length and a direct response of the transfer device to be obtained. As previously described, the elastic membrane 42 of the actuating member 15 is arranged on an upper side of the handle 11 and joined to the iron's housing 13 in one of the manners previously described. To transmit a movement of the actuating member 15 to the pump element 14, a push rod 27 acting as transmitting device is disposed between the actuating member 15 and the pump element 14. In one variant the actuating member 15 has an end area thereof formed in one integral piece with the rigid push rod 27. In a further variant, the actuating member 15 is of a rigid construction so that the deformation resistance is formed primarily by the membrane of the pump. This variant is applicable to any embodiment in which the membrane or the push rod 27 is coverable by a rigid actuating member.

Figure 16:
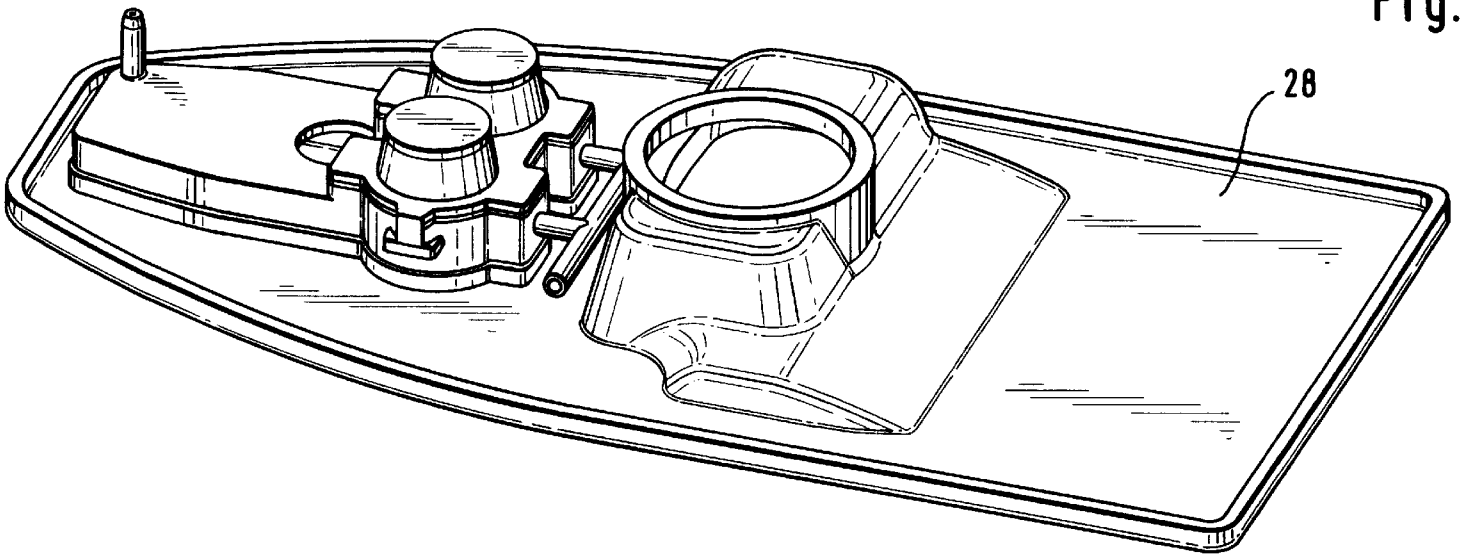
FIG. 16 is a perspective view of a tank's bottom part mounting the fluid transfer device of the embodiment of FIG. 15.
Figure 17:
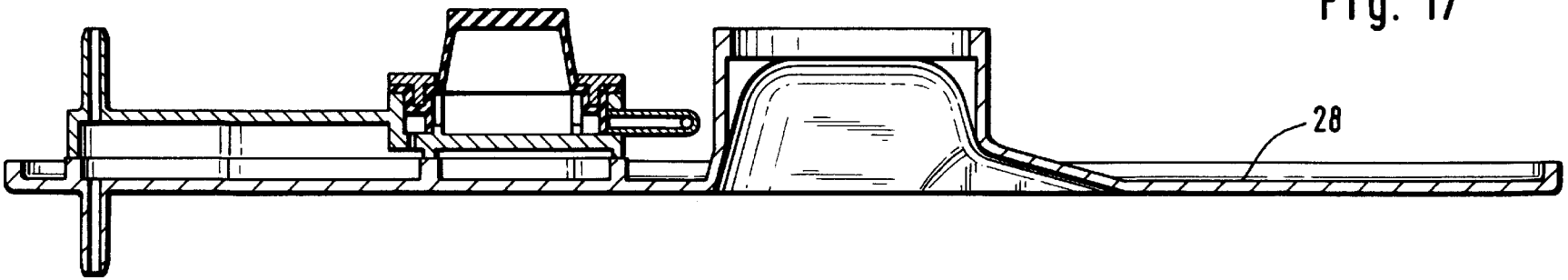
FIG. 17 is a sectional view of the tank's bottom part and the pump chamber mounted thereon in accordance with FIG. 16.

As FIG. 16 shows, a separate fluid transfer device is provided for the spray nozzle 9 and the steam burst function each, the devices being connected together to form a structural unit. In this arrangement the fluid transfer device is arranged directly on a bottom 28 of the fluid reservoir 6 (see also FIG. 17) in the interior thereof.

The embodiments described in the following can be implemented both in an arrangement of the fluid transfer device directly in the handle 11 of the pressing iron and in an arrangement of the fluid transfer device in a bottom area in the interior of the iron's housing with separate actuating member and pump element.

As FIG. 18 shows, preferably in the interior of the pump chamber 2 a return spring 29 is provided for returning the pump element 14 to its initial position. Hence the return of the pump element 14 is owed to the elasticity of the membrane 4 and, in addition, the restoring force of the return spring 29. As a result of the increased restoring force obtained by the return spring 29, aspiration of the fluid from the fluid reservoir 6 into the pump chamber 2 is more powerful and the return action proceeds more rapidly, thus permitting actuation in more rapid succession. An advantageous embodiment of the return spring 29 resides in that the spring is a spiral spring with a conical profile.

As FIG. 18 further shows, the check valves 7 and 10 which allow fluid flow in the supply conduit 5 and the discharge conduit 8 in only one direction each are formed by the elastic membrane 4 directly. The membrane 4 of the pump element 14 has valve sections 70 and 100 elastically movable between a first position in which the fluid conduit 5 and 8, respectively, is closed, and a second position in which the respective fluid conduit is open. The valve sections 70 and 100 are formed as self-supporting valve flaps capable of bending away when acted upon by a corresponding fluid pressure. In their position closing the fluid channel, the valve sections 70 and 100 abut a valve section stop 30 and 30*a,* respectively, which prevent bending away of the valve sections 70 and 100 in a direction in which fluid flow is to be inhibited. The abutment surfaces of the valve section stops 30 and 30*a* extend preferably normal to the direction of flow through the corresponding fluid conduit whose fluid flow is to be controlled by the valve sections.

The embodiment of FIG. 19 shows likewise check valves 7 and 10 formed directly by the membrane 4 itself. The corresponding valve sections 70 and 100 of the membrane 4 bear equally against valve section stops 30 and 30*a*. Preferably the valve sections have sealing areas 71 which cooperate with complementary valve seat areas on the respective fluid conduit 5 and 8 needing to be closed.

Figure 19A:
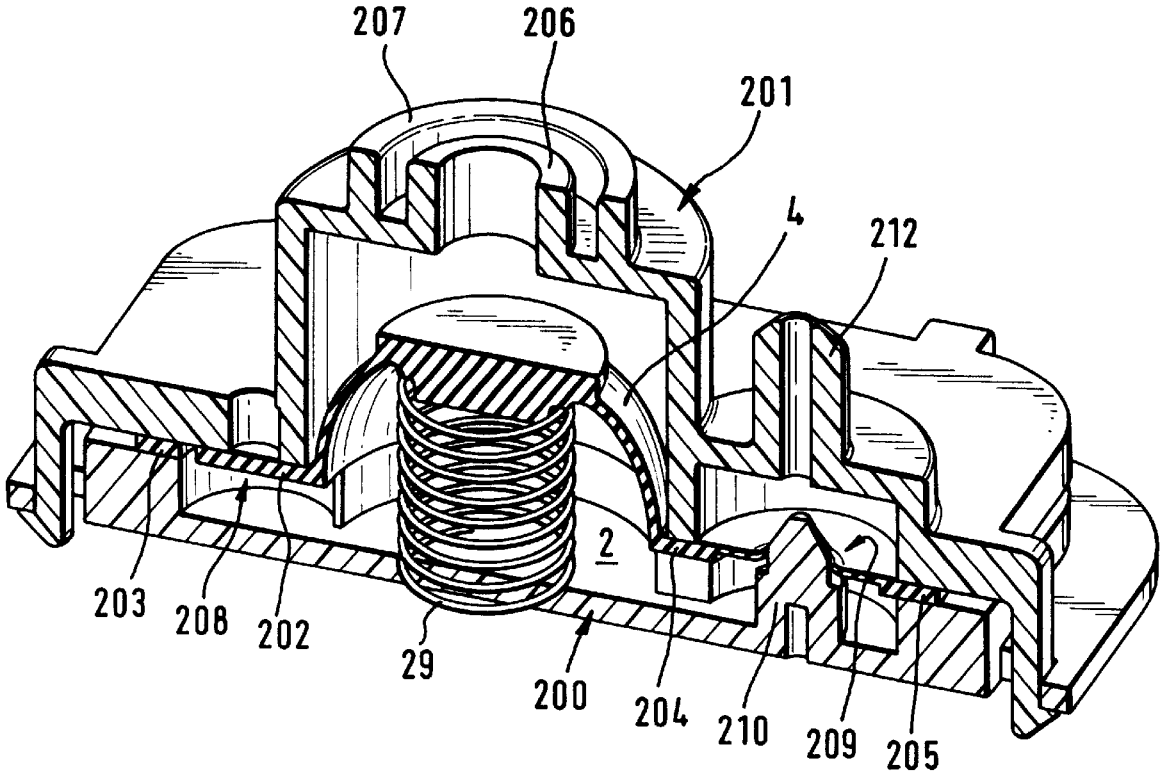
FIG. 19*a* is a perspective sectional view of a pump chamber similar to FIG. 18 or 19 in which the membrane has integrally formed valve sections, according to a still further embodiment of the present invention.
Figure 19B:
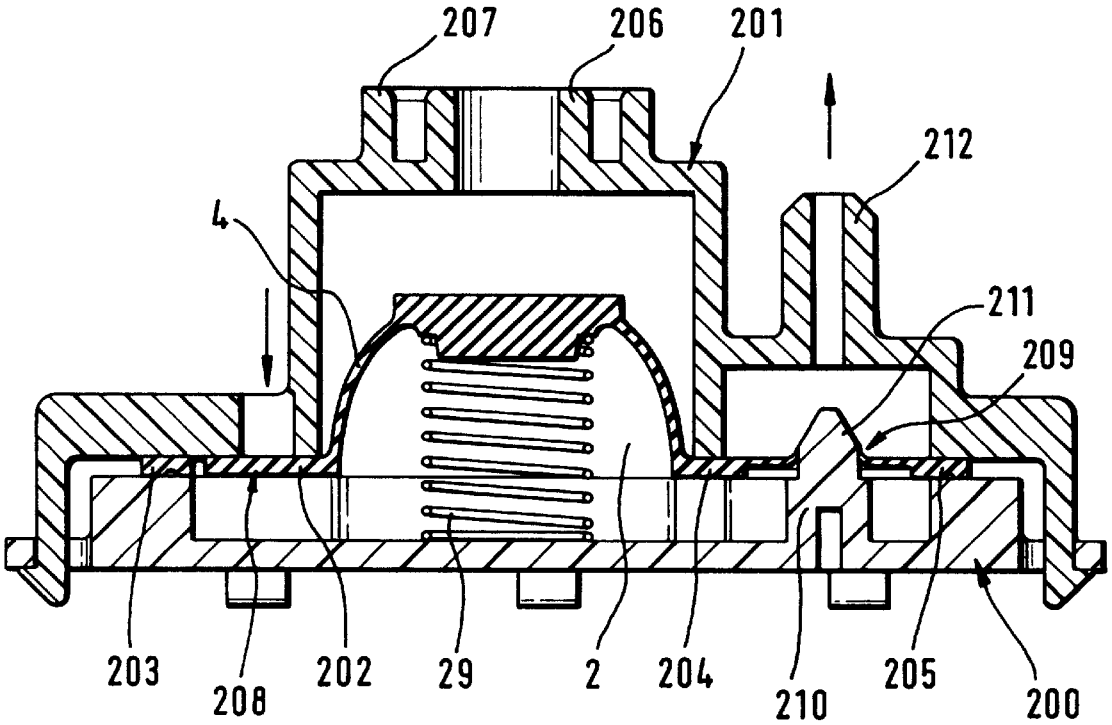
FIG. 19*b* is a sectional view of the pump module of FIG. 19*a;*
Figure 19C:
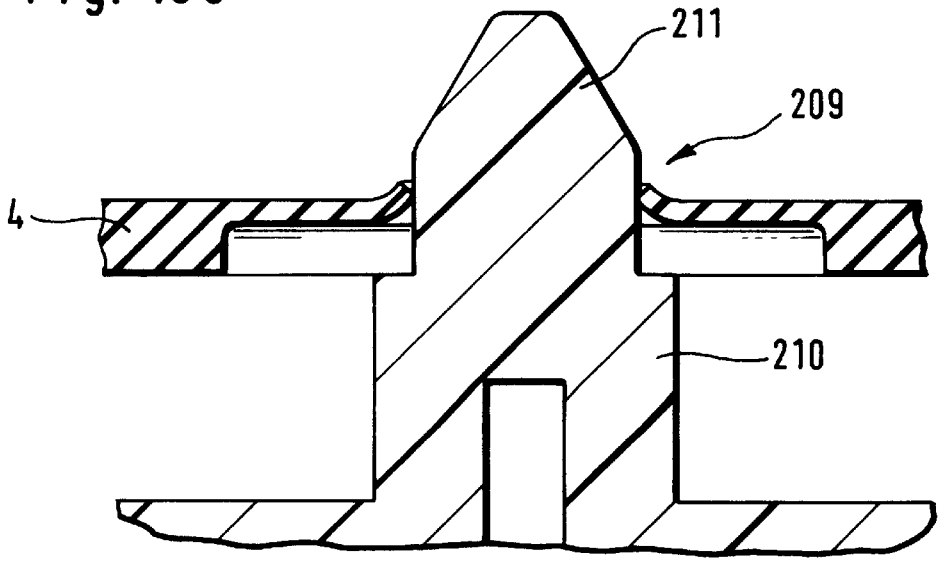
FIG. 19*c* is an enlarged sectional view of the outlet valve of FIG. 19*b;*

FIG. 19*a* shows a pump module similar to the one of FIG. 19, with the membrane 4 being clamped in place between a lower module part 200 and an upper module part 201. Where the membrane 4 makes contact with the module parts, it is compressed sufficiently to obtain a sealing sandwich structure. In this embodiment, therefore, the complete pump module is comprised of only three parts which can be plugged together one on top of the other, in a very simple assembly process. Optionally, a cylindrically shaped spring 29 is disposed in the pump chamber 2. The spring 29 operates to provide a restoring force for the membrane 4, independent of the permanent elasticity of the membrane 4. The spring 29 is fixedly held in position on the membrane 4 by a cylindrical extension of reduced diameter—relative to the inside diameter of the spring 29. As a result of this sandwich construction and the snap action of the upper pump module in snap-on connectors of the lower pump module, lateral areas 202, 203, 204 and 205 of the membrane 4 are press-fitted between the two rigid plastic module parts, thereby obviating the need for further seals. Hence the membrane 4 as an integral part represents not only the flexible pump chamber, the inlet and outlet check valves, but also the seal against the environment. Furthermore, the upper pump module 201 includes a guide section 206 for guiding the push rod 27. In the vicinity of the guide 206, a bead 207 is arranged in a circle concentric with the guide 206 for seating engagement with rubber seals for the push rod 27 opposite the membrane 4.

While the inlet check valve draws water directly from the liquid reservoir, an extension 212 is formed for the outlet check valve 209 on the upper pump module 201, which is adapted to communicate with the respective consuming device. The inlet valve 208 is formed as a circular elastic flap which is urged against the abutment surfaces of the upper pump module 201 as soon as the membrane 4 is depressed. By contrast, the outlet valve 209 is of a different structure illustrated again in FIG. 19*c* on an enlarged scale.

The outlet check valve 209 is formed by a section of the membrane 4 which is sufficiently thin compared to the neighboring sections to enable it to be deformed correspondingly. This thin elastic valve section of the outlet valve has a circular opening of a diameter smaller than the diameter of the pin 210 over which the elastic valve section is fitted. As soon as a pressure above atmospheric is produced in the pump chamber by depression of the pump membrane 4, the thin-walled elastic valve section of the outlet valve is urged upwardly towards the conically tapering section 211 of the pin 210, producing a gap through which water escapes from the pump module upwardly. Conversely, as soon as the pump membrane 4 moves from below in upward direction hence producing a pressure below atmospheric in the pump chamber, the outlet valve area is not opened because the pin 210 widens progressively in downward direction or an extension is formed as a stop. By comparison with other valve devices, this valve device 209 has the advantage of enabling a particularly good sealing effect to be obtained so that no afterdripping can be observed on the consuming devices.

It will be understood, of course, that the above-described structure comprising the lower pump module 200, the elastic membrane 4 and the upper pump module 201 is also suitable for utilization in connection with two pump modules connected in parallel. In consequence, also the use of two parallel-connected pump modules for two consuming devices requires only three parts 201, 200 and 4 (apart from the optional spring), because then the lower pump modules and the membranes 4 and the upper pump modules 201 can each be made of one piece.

Figure 19D:
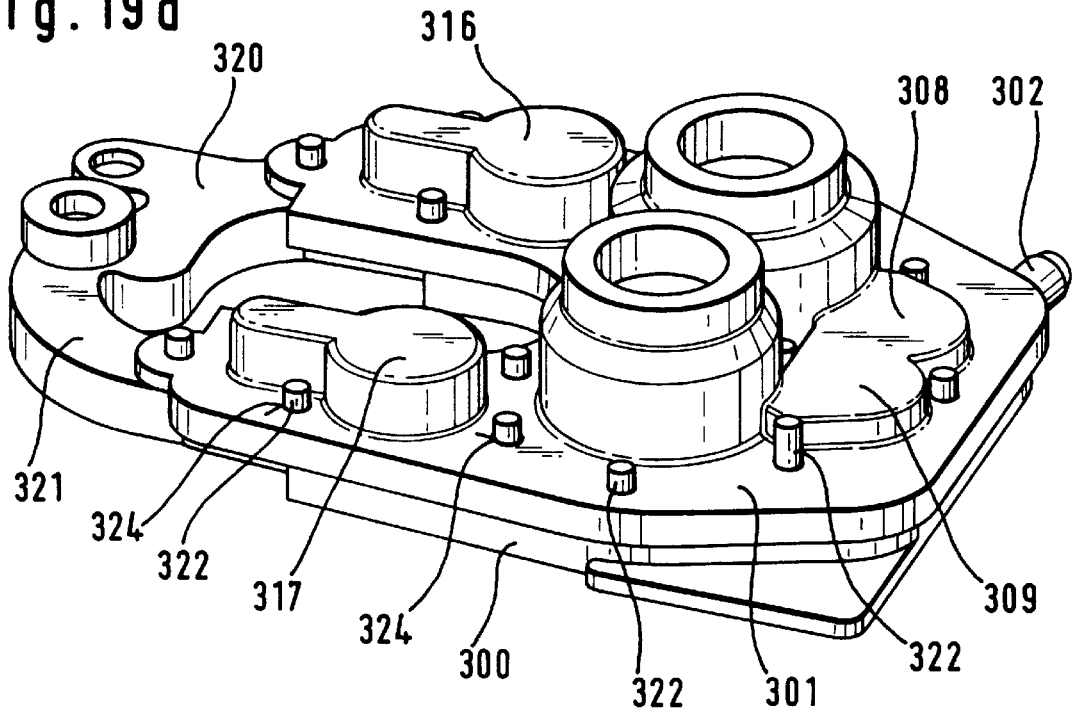
FIG. 19*d* is a perspective view of a fluid transfer device according to a further embodiment of the present invention.
Figure 19E:
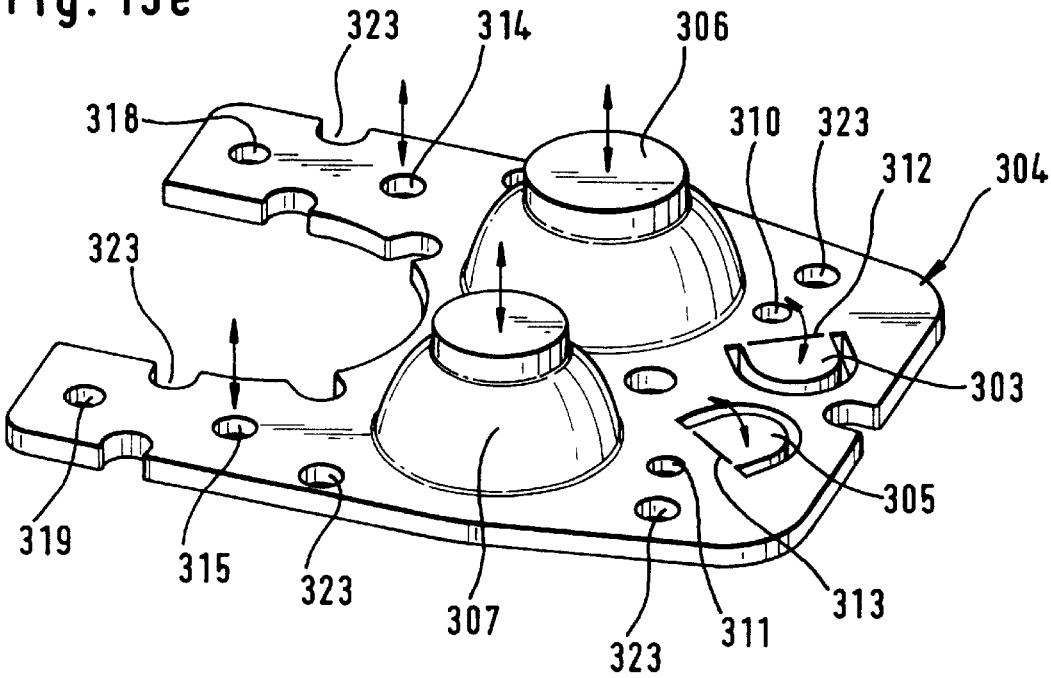
FIG. 19*e* is a perspective view of the membrane for a fluid transfer device of FIG. 19*d;*

The embodiment of FIGS. 19*d* and 19*e* is very similar to the embodiment just described so that subsequently only the particularities of this embodiment will be described. FIG. 19*d* shows a fluid transfer device in assembled condition in which particularly the lower module part 300 and the upper module part 301 are recognizable. In assembled condition of the pump, view of the membrane 304 is obstructed by the upper module part, the membrane being therefore illustrated separately in FIG. 19*e*.

Supply and discharge conduits are formed in the lower module part 300. A first supply conduit 302 is illustrated in FIG. 19*d*. A second supply conduit extends vertically from below in the lower module part 300. Both supply conduits draw the water from the fluid reservoir into which the ends of the supply conduits extend. Considering that the fluid transfer device is mounted on the fluid reservoir bottom, the supply path of the supply conduits is short. The water passes from the supply conduits to a respective opening underneath the flap-type elastic valve sections 303 and 305. On an upward motion subsequent to a push-down motion of at least one of the two dome-shaped pump elements 306, 307, the corresponding associated valve section 303, 305 is moved upwards as a result of the prevailing pressure below atmospheric, causing water to enter through the corresponding supply conduit into the respective pump chamber underneath the pump element. As this occurs, the water flows through one of the flow channels 308, 309 integrated in the upper molecule part 301 through the openings 310, 311 into the respective channel in the lower module part 300 which is in fluid communication with the pump chamber. The valve sections 303, 305 are free to swing upwardly into the flow channels 308, 309. FIG. 19*e* illustrates the U-shaped cutouts in the membrane, which surround the valve sections 303, 305 and allow the swinging motion. To facilitate the elastic swinging motion of the valve sections 303, 305, the material is thinned at 312, 313 in the membrane around the pivot axis.

When one of the pump elements 306, 307 is pressed down, the water held in the pump chamber flows through flow channels in the lower module part 300 to the outlet valve sections 314 and 315, respectively. The outlet valves are of the same configuration as in FIG. 19*c*. Return flow of the water into the supply conduits is prevented from occurring because the valve sections 303, 305 are urged against a bearing surface of the lower module part 300, which surface bounds the supply opening. Through the valve sections for the outlet the water flows through discharge conduits/channels 316, 317 formed by the upper module part and the membrane 304. Then the water flows through the openings 318 or 319 in the membrane into discharge conduits 320 or 321 of the lower module part 300.

It will be understood, of course, that both pumps which in this embodiment are combined in parallel to form a sandwich construction are operable independently of each other. The discharge conduit 320 is routed directly to the steam generating chamber arranged underneath for producing a steam burst. The discharge conduit 321 is routed to the water spray device.

In the iron's housing one actuating member each is of an elastic or rigid configuration and in communication with the pumps indirectly through a respective push rod which is passed through the fluid reservoir while its respective other end is in abutting engagement with the respective pump elements.

The assembly of this fluid transfer device is very simple. First a spring each is placed in the pump chamber in the lower module part 300. Then the membrane with the integrally formed pump elements 306 and 307 and valve sections 303, 305, 314, 315 is pushed on from above. The lower module part 300 has vertical mounting pins 322 for registration with complementary mounting openings or cutouts in the membrane 304 and mounting openings 324 in the upper module part 301 which are likewise adapted for plug-on mounting. Subsequently the upper module part 301 is pushed onto the lower module part and against the elasticity of the membrane 304 positioned therebetween, while at the same time hot punches act to deform the mounting pins 322 similar to a rivet, causing the membrane 304 to be fixed and clamped in place fluid-tight on all sides. Inserting the spring is optional because the pump elements 306, 307 already have a restoring spring characteristic.

Figure 20:
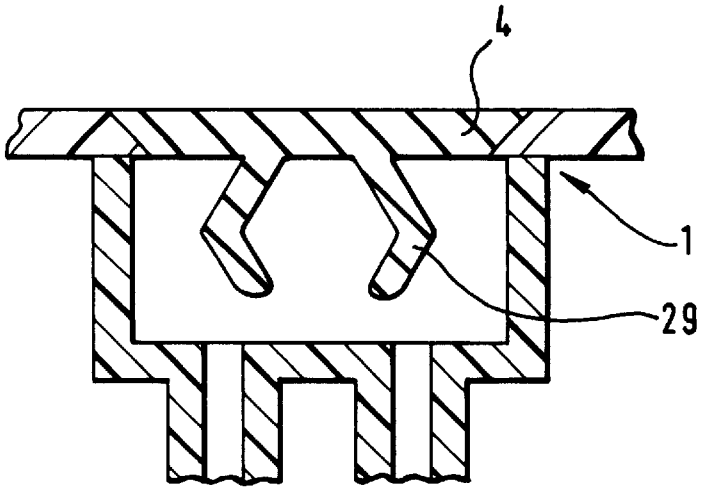
FIG. 20 is a sectional view of the pump chamber of a fluid transfer device in which the membrane includes spring elements formed thereon for elastic return of the membrane, according to a further embodiment of the present invention.

To increase the restoring force of the elastic membrane 4, the return spring 29 may be formed as spring elements integrally formed with the elastic membrane 4, for example. As FIG. 20 shows, the spring elements forming the return spring 29 are preferably connected with the central area of the membrane 4 to bias said area back into its initial position on deformation of the membrane. Preferably, the spring elements are formed as curved ledges protruding into the interior of the pump chamber 2 so as to abut the bottom of the pump chamber 2 and deform when the membrane 4 is pushed in. As this occurs, the spring elements are preferably subjected to bending. To obtain a defined pressure point of the membrane 4, the integrally formed spring elements may also be of an essentially straight profile, thus possessing an increased initial resistance to deformation which, upon buckling of the spring elements, drops relatively steeply.

Figure 21:
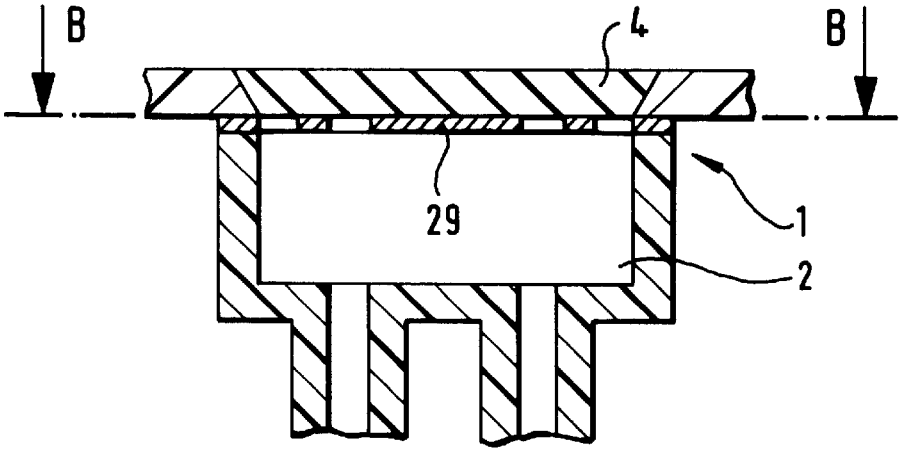
FIG. 21 is a sectional view similar to FIG. 20 in which the pump chamber housing includes an integrally formed spring element for returning the membrane, according to a further embodiment of the present invention.
Figure 22:
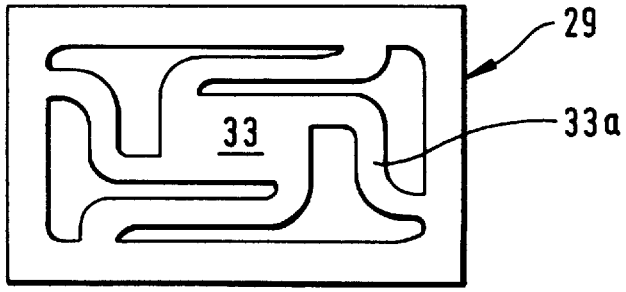
FIG. 22 is a top plan view of the spring element of FIG. 21, taken along the line B—B of FIG. 21.

A further preferred embodiment of the present invention also resides in that the return spring 29 is formed in one integral piece with a section of the housing 1 of the pump chamber 2. As FIG. 21 shows, the return spring 29 is arranged directly beneath the membrane 4 in the pump chamber 2 so that the membrane 4 sits on the return spring 29 in its position of rest. In this embodiment the return spring 29 has several spring arms 33*a* which are interconnected in the central area of the pump chamber 2 while having their other edges connected with edge sections of the housing 1 disposed around the membrane 4. The spring arms 33*a* are curved, preferably in meandering fashion, in particular curved in S-shape in order to effect the elasticity of the spring arms 33*a*. To connect the spring arms 33*a* provision is preferably made in the central area of the pump chamber 2 for a substantially plate-shaped membrane supporting element 33 supporting the membrane 4 in its central surface area and biasing it to its initial position on deformation.

Where applicable, it is possible for the individual embodiments of the return spring 29 to be combined to obtain a desirable spring characteristic or restoring characteristic.

Figure 23:
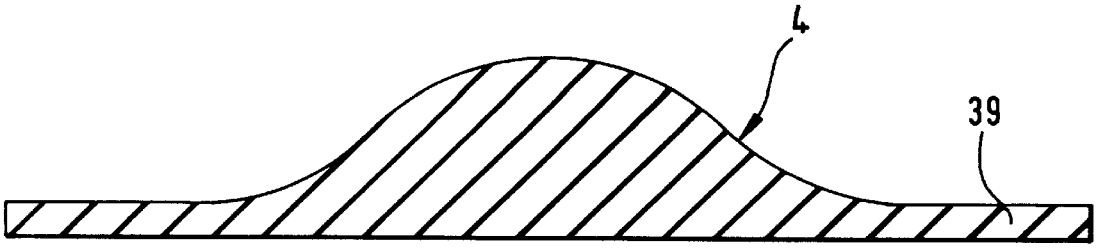
FIG. 23 is a sectional view of a membrane having a hill-shaped thickening in the central region as pressure area, according to one embodiment of the present invention.

A preferred embodiment of the membrane 4 is illustrated in FIG. 23. The membrane 4 has a substantially disk-shaped peripheral area 39 suitable for fastening or forming the membrane integral with the housing 1. The thickness of the membrane 4 increases progressively from the peripheral area to the center so that the stiffness of the membrane increases also in the direction of the center. The upper side of the membrane, that means, its side close to the operator's finger, is arched in convex shape, forming in the central area a raised pressure area affording ease and convenience of operation. The underside, that is, the side of the membrane 4 close to the pump chamber 2, is of an essentially flat configuration. When the membrane is pressed down, it is predominantly subjected to tensile stress internally. On account of its uniformly extending form the membrane is exposed to uniform loads resulting in a prolonged service life.

Figure 24:
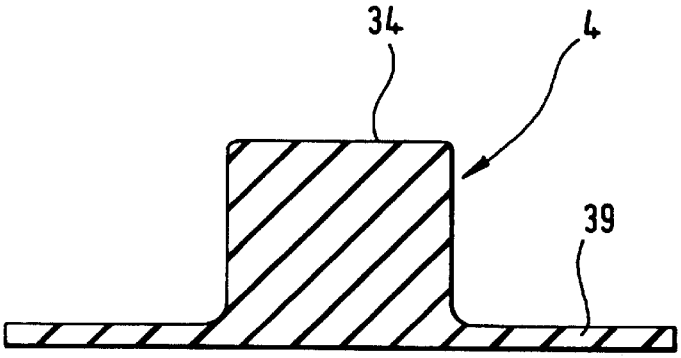
FIG. 24 is a sectional view of a membrane having a cylindrically raised pressure area according to another embodiment of the present invention.

When it is desired to join the membrane not directly to the outer housing of the pressing iron but with its peripheral area underneath thereof to the pump housing, the membrane 4 may be of a significantly increased thickness in its central area. According to the preferred embodiment of FIG. 24 the membrane may have in its center an essentially cylindrical or, alternatively, brick-shaped pressure area 34 raised in step form. The significantly raised pressure area 34 makes depression of the membrane 4 particularly easy and actuation of the fluid transfer device correspondingly convenient. In its peripheral area 39 the membrane 4 is essentially disk-shaped. When the membrane is pressed down, it is predominantly subjected to tensile stress internally in the elastic area.

According to a further preferred embodiment of the present invention, the membrane may be generally dome-shaped, including preferably a straight, inclined flank area arranged to slope downwardly from a central mid-area to the edges of the membrane. The central mid-area is of increased thickness, while the flank section 35 is relatively thin by comparison so that it bends away in bellows fashion when the membrane is pressed down. The central mid-area forms an essentially plane, raised pressure area 34. In the area of the flank section 35 the membrane is predominantly subjected to bending. Owing to the straight, sloping flank section 35 the membrane has in its initial position a relatively high deformation resistance which diminishes relatively significantly upon initial buckling or bending out. The membrane possesses a defined pressure point. On deformation of the membrane, the dome-shaped configuration with its deformation-resistant central portion produces a large volume variation in the pump chamber 2 and a correspondingly high pump output.

Figure 25:
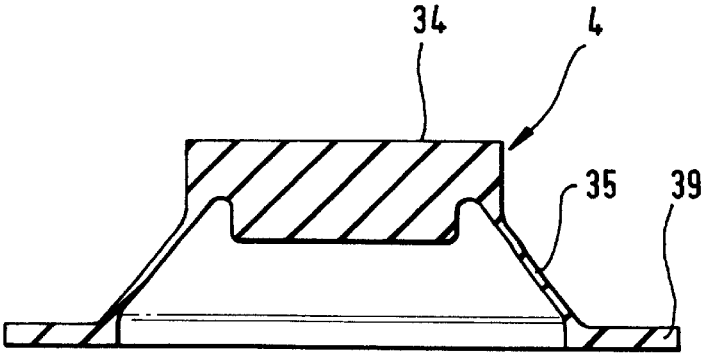
FIG. 25 is a sectional view of a membrane having a pressure area elevated in dome-shaped fashion and a peripheral area intended for buckling, according to one embodiment of the present invention.
Figure 26:
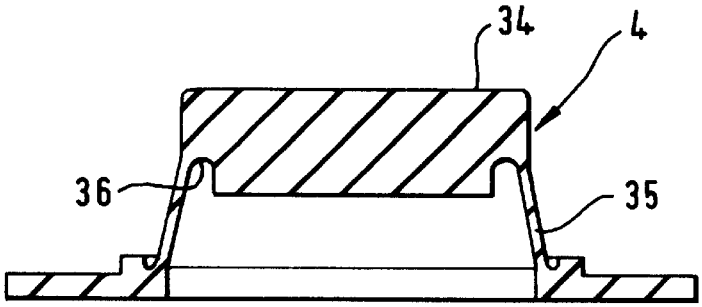
FIG. 26 is a sectional view of a membrane having a pressure area raised in dome-shaped fashion similar to FIG. 25, provision being made for a buckling notch in the peripheral area, according to a further embodiment of the present invention.

FIG. 26 shows an embodiment of the membrane similar to FIG. 25, but with a more pronounced inclination of the flank section 35, meaning that the flank section encloses a smaller angle with the direction of depression, being accordingly steeper. This results in a still higher initial resistance and pressure point. To obtain a uniform deformation of the flank section 35, a rounded notch 36 similar to the embodiment of FIG. 25 is provided on the membrane's underside between the flank section 35 and the thickened mid-area of the membrane (see FIG. 26).

Figure 27:
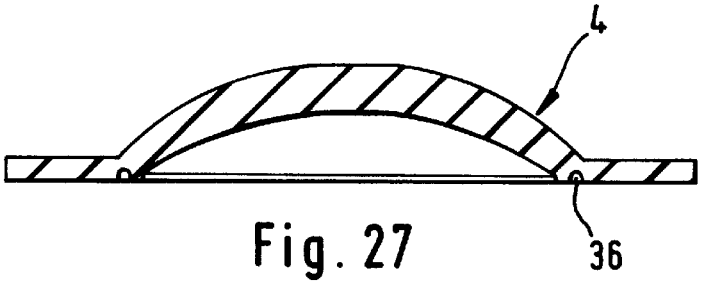
FIG. 27 is a sectional view of a membrane of a generally dome-shaped configuration.
Figure 28:
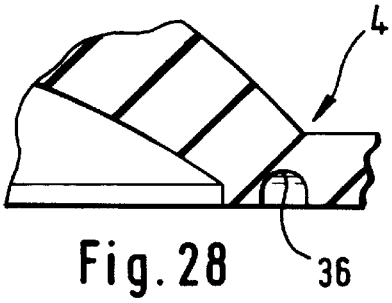
FIG. 28 is a sectional view, on an enlarged scale, of the peripheral area of the membrane of FIG. 27 showing a buckling notch on the underside of the membrane.

A further preferred embodiment of a membrane 4 is illustrated in FIG. 27. The membrane 4 has its central area arched in dome shape. The thickness of the membrane between the root points of the dome-shaped arch is substantially uniform, diminishing slightly from the center of the membrane to the root points of the dome-shaped arch. The disk-shaped peripheral areas of the membrane are of slightly reduced thickness relative to the dome-shaped mid-area. The height of the dome-shaped arch amounts to about one fifth of the diameter of the domed portion of the membrane. To obtain a uniform loading of the membrane throughout, notches 36 are provided on the underside of the membrane in the area of the root points of the dome-shaped arch, said notches being shown in FIG. 28 on an enlarged scale. The domed membrane 4 of FIG. 27 is subjected to both tensile and bending stresses on depression.

Figure 29:
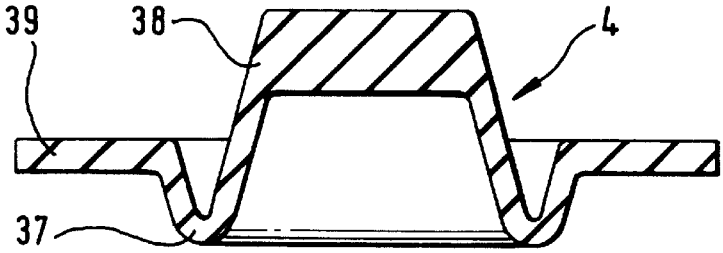
FIG. 29 is a sectional view of a membrane having a cylindrically raised pressure area and a peripheral area intended for buckling, according to a further embodiment of the present invention.

FIG. 29 shows a further embodiment of a membrane 4 exhibiting equally a very favorable buckling behavior (see claim 9). To this end, one part 37 of the membrane is arranged at a level below the peripheral area 39 while another part 38 of the membrane 4 is arranged at a level above the peripheral area 39 of the membrane 4. The portion connecting the peripheral area 39 with the upper part 38 of the membrane 4 is of U-shape in cross section resulting in a predetermined buckling notch.

It should be noted that in addition to the ways of connecting together the individual parts so far described, the parts can also be joined together by plastic welding, adhesive bonding or snap-fitting using snap-in locking mechanisms.

The fluid transfer device has been described in the foregoing in connection with a pressing iron. It will be understood, however, that the fluid transfer device may also find useful application in other domestic appliances. However, the fluid transfer device described herein is of particular advantage for the transfer of fluid in pressing irons.

According to a further essential aspect of the present fluid transfer device, a particularly advantageous embodiment of the transfer device may also reside in that the pump chamber is formed in the manner of a cushion from an elastic membrane disposed between pump chamber shells. By compressing the pump chamber shells, the membrane is likewise compressed, whereby the volume of the membrane cushion becomes smaller and a corresponding pump action can be obtained.

What is claimed is:

1. A manually operated fluid transfer device for a pressing iron, comprising:

a housing comprising an upper and a lower module part, said housing accommodating therein a pump chamber, the pump chamber having at least one valve passage;

a pump element for varying the pump chamber volume, said pump element (14) being formed as a deformable membrane;

supply conduit and a discharge conduit which are in communication with the pump chamber; and at least one valve section associated with the at least one valve passage, the valve section adapted to move elastically between a first position in which the associated valve passage is closed and a second position in which the associated valve passage is open, said at least one valve section being formed in one integral piece with the deformable membrane of the pump element, the deformable membrane being clamped in sandwich fashion between the lower and the upper module part.

2. The manually operated fluid transfer device as claimed in claim 1, wherein the supply and discharge conduits each has an orifice and the at least one valve section comprises an inlet valve section and an outlet valve section, the supply conduit, the pump chamber and the discharge conduit forming a fluid path, and wherein the deformable membrane is clamped in place between the upper and the lower module part in such manner that the fluid path of the fluid transfer device is sealed against the outside of the fluid transfer device except for the orifices through the supply and discharge conduits and within the fluid transfer device between the inlet and outlet valve sections and the pump chamber.

3. The manually operated fluid transfer device as claimed in claim 1 wherein the pump chamber has an inlet valve passage associated with the supply conduit and an outlet valve passage associated with the discharge conduit and the inlet and outlet valve passages are incorporated in the upper and lower module parts.

4. The manually operated fluid transfer device as claimed in claim 2 wherein the inlet and outlet valve sections are located adjacent to the pump chamber, enabling the deformable membrane with the inlet and outlet valve sections to be injection-molded as a three-dimensional molding.

5. The manually operated fluid transfer device as claimed in claim 3, wherein the housing includes a pin located in one of the inlet and outlet valve passages and an associated one of the inlet and outlet valve sections of the flexible membrane includes a bore of a diameter dimensioned such that the valve valve section of the flexible membrane is in sealing engagement around the pin when said associated one of said inlet and outlet valve sections is in the first position, and wherein said associated one of said inlet and outlet valve sections is elastically deformable by a fluid pressure to produce a gap between the pin and the valve section of the deformable membrane when said one of said inlet and outlet valve sections is in the second position.

6. The manually operated fluid transfer device as claimed in claim 2, wherein the pump element with the deformable membrane and the inlet and outlet valve sections are formed as an elastic, rubber-like plastic part and the lower and the upper module parts are formed as hard-plastic parts.

7. The manually operated fluid transfer device as claimed in claim 1, wherein the membrane is configured such that a deformation resistance of the deformable membrane in a position of rest of the membrane has an initially high value, dropping to lower values after an initial deformation force exceeds said initially high value, said lower values being less than the initially high value.

8. The manually operated fluid transfer device as claimed in claim 1, wherein the deformable membrane of the pump element is of greater thickness in a central area than in peripheral areas for increased relative stiffness in the central area.

9. The manually operated fluid transfer device as claimed in claim 1, wherein the deformable membrane has a side surface opposite the pump chamber, the side surface having a convex configuration.

10. The manually operated fluid transfer device as claimed in claim 1, wherein the deformable membrane has a pressure area and a peripheral area, the pressure area being raised relative to the peripheral area.

11. A pressing iron comprising:

a housing;

a supply conduit substantially contained within the housing, the supply conduit having an orifice for supplying fluid therefrom;

a discharge conduit substantially contained within the housing, the discharge conduit having an orifice for receiving fluid therein; and a fluid transfer device contained substantially within the housing for transferring fluid from the supply conduit to the discharge conduit, the fluid transfer device comprising:

a fluid transfer housing comprising an upper and a lower module part, said fluid transfer housing accommodating therein a pump chamber, the fluid transfer housing further comprising an inlet valve passage connected to the orifice of the supply conduit and an outlet valve passage connected to the orifice of the discharge conduit, the inlet valve passage, the pump chamber and the outlet valve passage together defining a fluid flow path;

a pump element for varying the pump chamber volume, said pump element comprising a deformable membrane having at least one valve section adapted to move elastically between a first position in which one of said inlet and said outlet valve passages is closed and a second position in which said one of said inlet and said outlet valve passages is open, said deformable membrane with the valve section and the pump element being formed in one integral piece and clamped in sandwich fashion between the lower and the upper module parts.

12. The pressing iron as claimed in claim 11, further comprising an actuating member having an exposed surface for direct or indirect actuation of the pump element.

13. The pressing iron as claimed in claim 12, wherein the exposed surface of the actuating member is arranged essentially flush with an outer surface of the housing of the iron, the exposed surface being essentially a continuation of the outer surface of the housing of the iron.

14. The pressing iron as claimed in claim 11, wherein the actuating member is part of the housing of the iron.

15. The pressing iron as claimed in claim 11, wherein the fluid transfer housing is fixedly connected with the housing of the iron.

16. The pressing iron as claimed in claim 11, further comprising a fluid reservoir, the fluid transfer housing being fixedly connected with the fluid reservoir.

17. The pressing iron as claimed in claim 16, wherein the fluid transfer device is located in an interior portion of the fluid reservoir (6).

18. The pressing iron as claimed in claim 12, wherein the actuating member has an exposed surface for indirect actuation of the pump element, the actuating member further comprising a push rod disposed between the deformable membrane of the pump element and the actuating member, so that a force introduced into the actuating member is transmitted to the membrane.

19. The manually operated fluid transfer device of claim 4 wherein the three-dimensional molding of the deformable membrane with the inlet and outlet valve sections is shaped to be injection-molded without undercuts.

20. The pressing iron of claim 12, wherein the actuating member has an exposed surface for direct actuation of the pump element, the actuating member comprising the deformable membrane.

21. The pressing iron of claim 15 wherein the pressing iron further comprises a handle, the fluid transfer housing being fixedly connected with the handle.

22. The pressing iron of claim 18 wherein the actuating member comprises a second deformable membrane.

23. A manually operated fluid transfer device for a pressing iron comprising:

a housing comprising an upper and a lower module part, an inlet valve passage for connection to an orifice of a supply conduit and an outlet valve passage for connection to an orifice of a discharge conduit;

a pump chamber accommodated within the housing, the inlet valve passage, the pump chamber and the outlet valve passage together defining a fluid flow path, the pump chamber having a rigid housing portion and a deformable elastic membrane, the deformable membrane acting as a pump element for varying the pump chamber volume to force fluid through the fluid flow path, the rigid wall portion and the deformable membrane forming an integral wall of the pump chamber.

24. The manually operated fluid transfer device of claim 23 wherein the integral wall formed by the rigid wall portion and the deformable membrane has a continuous smooth surface.

25. The manually operated fluid transfer device of claim 24 wherein the integral wall of the pump chamber comprises a fluid tight joint between the rigid wall portion and the deformable membrane.

* * * * *

UNITED STATES PATENT AND TRADEMARK OFFICE

CERTIFICATE OF CORRECTION

PATENT NO. : 6,249,996 B1 
DATED : June 26, 2001
INVENTOR(S) : Josep Recasens, Ralf Dorber, Antonio Rebordosa, Antonio Condes, Desideri Falco Sastre and Miguel-Angel Jimenez Colas It is certified that error appears in the above-identified patent and that said Letters Patent is hereby corrected as shown below:

Title page,
Item [75], Inventor, "Miguel-Angel Colas Jimenez" should be -- Miguel-Angel Jimenez Colas --; and "Desideri Sastre Falco" should be -- Desideri Falco Sastre --.

Column 17,
Line 59, insert -- a -- before "supply".

Signed and Sealed this

Twenty-sixth Day of November, 2002

*Attest:*

*Attesting Officer*

JAMES E. ROGAN
*Director of the United States Patent and Trademark Office*